US006309170B1

(12) United States Patent
Vartanian

(10) Patent No.: US 6,309,170 B1
(45) Date of Patent: Oct. 30, 2001

(54) VEHICLE WHEELCHAIR LIFT WITH MUTUALLY PERPENDICULAR PIVOT AXES AND PARALLELOGRAM TRANSPORT

(76) Inventor: Roger Vartanian, P.O. Box 636, Broadheadsville, PA (US) 18322

( * ) Notice: Subject to any disclaimer, the term of this patent is extended or adjusted under 35 U.S.C. 154(b) by 0 days.

(21) Appl. No.: 09/375,714

(22) Filed: Aug. 17, 1999

(51) Int. Cl.[7] ..... A61G 3/06
(52) U.S. Cl. ..... 414/546; 414/550; 414/921
(58) Field of Search ..... 414/546, 550, 414/921

(56) References Cited

U.S. PATENT DOCUMENTS

| | | | | |
|---|---|---|---|---|
| Re. 31,178 | | 3/1983 | Deacon | 414/546 |
| 4,140,230 | * | 2/1979 | Pearson | 414/921 X |
| 4,456,421 | * | 6/1984 | Robson | 414/550 X |
| 4,534,450 | * | 8/1985 | Savaria | 414/921 X |
| 4,664,584 | | 5/1987 | Braun et al. | 414/541 |
| 4,804,308 | * | 2/1989 | Hamblin et al. | 414/540 |
| 4,808,056 | * | 2/1989 | Oshima | 414/921 X |
| 4,966,516 | * | 10/1990 | Vartanian | 414/921 X |
| 4,984,955 | * | 1/1991 | McCullough | 414/921 X |
| 5,234,311 | * | 8/1993 | Loduha, Jr. et al. | 414/921 X |
| 5,261,779 | | 11/1993 | Goodrich | 414/546 |
| 5,542,811 | | 8/1996 | Vartanian | 414/541 |
| 5,806,632 | | 9/1998 | Budd et al. | 187/200 |

OTHER PUBLICATIONS

Brochure—The Braun Corp., "L200UARS Series Ultra IV Wheelchair Lifts" 7/98, 1 page.
Brochure—Ricon Corp., "UNI–Lite," 7/96, 2 pages.

* cited by examiner

*Primary Examiner*—Steven A. Bratlie
(74) *Attorney, Agent, or Firm*—Duane Morris & Heckscher LLP

(57) ABSTRACT

A wheelchair lift is mounted in a vehicle doorway and provided with at least three distinct modes in which a supporting platform can be moved. The platform is affixed to vertical standards guided by parallelogram linkages between the standards and fixed posts mounted in the vehicle doorway. The parallelogram linkages hold the standards at a fixed orientation relative to the posts and keeps the platform horizontal as it is raised or lowered between ground level and the level of the vehicle passenger compartment. The platform is pivotable on a horizontal axis at the connection between the platform and the movable standards such that the platform can be raised from a horizontal wheelchair-carrying orientation to a compact vertical orientation in which the platform is stowed in the plane of the vertical standards, which are disposed against or between the fixed posts. The platform also is attached to the vertical standards on a vertical axis so as to hinge in the manner of a gate to clear the doorway for passage. Heavy journal posts attach the platform to the vertical standard on one lateral side of the lift and on the opposite lateral side a heavy duty clamping latch captures a bar protruding from the platform adjacent to its horizontal hinge axis. Safety roll-off gates are disposed on the inboard and outboard sides of the platform. Handrail members and one or more passage blocking barriers are automatically deployed when the platform is moved away from its stowed position.

18 Claims, 13 Drawing Sheets

VEHICLE WHEELCHAIR LIFT WITH MUTUALLY PERPENDICULAR PIVOT AXES AND PARALLELOGRAM TRANSPORT

BACKGROUND OF THE INVENTION

1. Field of the Invention

The invention concerns a lift mechanism for transferring a load between laterally adjacent supporting surfaces at different elevations, especially for moving a load in either direction between a vehicle compartment and the ground alongside the vehicle. The lift mechanism permits different relative motions which are effected alternately or successively when stowing, deploying and moving a platform that supports the load, especially a wheelchair, to be moved back and forth between the passenger compartment of a vehicle such as a van, bus or light truck, and the ground adjacent to such vehicle.

The lift has a substantially vertical fixed frame rigidly mounted to span a vehicle doorway. A partial frame is mounted to move up and down relative to the fixed frame. The partial frame is engaged with the fixed frame when the partial frame is in the upper or retracted position, namely via interengaging protruding and receptacle members at each corner of the fixed and partial frames, which interengaging members position the partial frame relative to the fixed frame and mechanically support the partial frame on the fixed frame. The pivoting frame supports a platform and has vertical and horizontal pivot axes whereby a movable platform can swing into or out of the plane of the doorway on a vertical hinge axis; and the platform can be shifted on a horizontal pivot axis between a vertical stowed position and a horizontal deployed position in which the platform can support a wheel chair or the like.

Using the foregoing frames and hinging or pivoting mountings, the whole lift mechanism can be retracted into a substantially vertical position in which the platform is pivoted up and resides in the doorway. The partial frame can be moved up and down from the doorway, carrying along the pivot frame and platform. When the platform is pivoted up, the pivot frame can be hinged open or shut on the vertical axis. When the pivot frame is hinged shut on the vertical axis the platform can be pivoted down into its horizontal supporting position. These superimposed degrees of freedom of motion are possible because the pivoting frame is carried on a very substantial vertical hinge post, and the partial frame is mechanically engaged in, and partially supported by the fixed frame when raised into the retracted position. The lift thus comprises portions that can be can be hinged open vertically to clear the doorway for passing into and out of the vehicle through an open doorway, or hinged closed across the doorway. The lift further comprises a platform that pivots down to provide a wheel chair support or up for compact stowing. With the platform pivoted down to the supporting position, the partial frame can lift or lower the platform on linkages. The platform thereby raises a wheel chair supported on the platform to the elevation of the vehicle interior floor, or lowers a wheel chair supported on the platform from the vehicle floor to the ground.

The pivoting frame is carried on the partial frame and the partial frame is carried on a parallelogram linkage for guiding the partial frame up or down through an arc, while holding the partial frame parallel to the fixed frame in the doorway. This partial frame supports a platform that is pivotally coupled to the partial frame on a horizontal pivot axis. The platform is pivoted on the horizontal axis to an orientation parallel to the ground and perpendicular to the partial frame, when supporting a load such as the wheelchair. The platform is movable with the partial frame on the parallelogram linkage, from the vehicle compartment level to the ground level, being kept horizontal by the parallelogram linkage. Roll-off gates, barriers and hand holds are provided for safety.

In the reverse order, the platform can transfer a wheelchair from the ground level to the vehicle compartment, whereupon the safety gates and barriers permit the wheelchair to roll into the vehicle. The platform is pivoted up on the horizontal axis, thus moving each of the platform, the partial frame and the pivoting frame into the plane of the fixed frame for compact storage. In this position the mechanism, except for the fixed frame and partial frame, can be unlatched and pivoted clear of the doorway opening.

Accordingly the apparatus has at least three distinct modes of movement. In one mode, the parallelogram linkage holds the platform in a horizontal orientation as the platform is raised or lowered between ground level and the level of the vehicle passenger compartment, opening the movable gates or barriers to permit the wheelchair to roll onto and off of the platform at either level.

In a second mode, the platform is pivotable on a horizontal axis with the movable chassis (i.e., the partial frame) on the inboard side of the platform. The platform can be pivoted on this axis and raised from its horizontal wheelchair-carrying orientation to a vertical orientation. With the platform vertical and the movable chassis retracted, the elements of the mechanism are substantially coplanar with the doorway and the fixed frame. Thus the entire mechanism resides across the vehicle doorway.

The platform is mounted on the movable vertical chassis members by a heavy duty journal post on one lateral side and by a heavy duty clamping latch on the other lateral side. By opening the clamping latch the platform (preferably as folded upwardly into its stowed position), the platform can be swung, in a third mode, clear of the doorway in the manner of a hinged gate frame.

The movable roll-off gates, handrail members and doorway plane barriers for safety purposes preferably are linked and structured for automatic deployment when the platform is in the position where such gates, members and barriers are useful, and for retraction otherwise. For this purpose the handrail members and doorway plane barriers preferably are coupled mechanically to the platform and the parallelogram linkage, respectively. A roll-off gate is provided at each opposite side of the platform. On the inboard side the gate is lowered by a roller contacting the base of the fixed frame at the sill of the vehicle doorway and comprises a transition ramp that is lowered against the base of the fixed frame as the gate is lowered. On the outboard side a similar roller lowers the opposite gate when contact is made with the ground. At least on the outboard side a position latch captures the gate mechanism until lifted by contact between the roller and the ground. As a result, the roll-off gate cannot be opened inadvertently by rolling the wheelchair against it when the platform is not on the ground.

More particularly, a mounting structure having laterally-spaced fixed vertical posts is rigidly mounted in the vehicle doorway, inside the innermost (closed) position of the vehicle outer door, leaving clearance for the outer door hinges and latch mechanism. The fixed vertical posts preferably extend from the vehicle floor to the roof. An upper horizontal header and a lower horizontal base or sill are disposed around the doorway or a portion of the doorway, and frame the doorway together with the vertical posts. The laterally spaced vertical standards of the movable chassis are attached to the fixed posts by a parallelogram linkage, namely at least two parallel pivot arms pivotally affixed to the fixed posts and vertical standards such that the standards remain parallel to the fixed posts. Preferably such a parallelogram linkage is provided at each lateral side of the lift.

The movable standards reside against the fixed posts in the retracted position of the lift. The parallelogram linkage collapses when the standards are retracted inboard and opens when the standards are deployed outwardly and downwardly to lower the lift. In this manner the parallelogram linkage(s) keep the movable standards parallel to the fixed frame (substantially vertical) and keep the wheel chair supporting platform horizontally oriented when deployed.

The platform is attached to the movable vertical standards on a horizontal hinge axis extending between the standards adjacent their lower ends. The platform can be pivoted up into a vertical position, substantially in the plane of the standards, where the platform is stowed in a position comparable to a door panel, or positioned horizontally to support the wheelchair or other load. A drive device such as a linear actuator motor is provided for this purpose. The movable standards are connected to the fixed posts by a set of parallelogram arms. Hinging on the horizontal axis can be effected manually, but a drive powered by an electric linear actuator is preferred. Independent pivoting of the platform on a vertical hinge axis permits the vertically stowed platform to be pivoted clear of the doorway around one of the movable vertical standards.

The vertical hinge axis is defined by one or more heavy journal posts, as needed to support the weight of the platform when hinged open. At the same time, the movable standards are engaged with and supported on the fixed posts, forming a stable structure from which the platform can hinge on the journal post, without sagging. A particularly robust and secure clamped latch arrangement is provided between the platform and the adjacent movable vertical standard on the side opposite from the vertical hinge. The clamped latch comprises a leveraged operator that fixes a protruding bar adjacent to the horizontal pivot axis of the platform, received in a structurally supportive receptacle coupled to the vertical movable frame. The journal post and clamping latch bear the concentrated load of a wheel chair on the platform when cantilevered outwardly.

2. Prior Art

U.S. Pat. No. 4,664,584—Braun et al. discloses a wheelchair lift for a van, having a horizontal platform mounted to a telescoping drive post carrying a hydraulic actuator for moving the horizontal platform vertically up and down between the ground and the level of the floor of the passenger compartment. The apparatus is attached to the floor of the van and is mounted inside a side door. The movable parts of the lift, namely the platform and the vertical drive post, hinge on a vertical axis. The entire lift is mounted inside the van at the edge of the doorway. For disembarking, the wheelchair is rolled onto the platform inside the van; the platform is rotated outwardly around the vertical pivot post to move the telescoping post and platform outward sufficiently to clear the passenger compartment; the platform is lowered to the ground; and the wheelchair is rolled off. For embarking the opposite steps are taken.

A lift as in Braun is mounted such that all the elements of the lift can be moved completely inside the vehicle, allowing the door to be closed. When the door is open, the device extends a portion outwards and lowers it, both typically by means of actuators. It is an inherent aspect of a device as described that the vertically displaceable platform or similar load carrying part, and also the mechanism that raises and lowers it (i.e., the telescoping post), must be movable fully outside of the vehicle doorway to provide clearance to lower the platform to the ground. These elements must also be movable entirely inside of the passenger compartment, by linear retraction and/or pivoting, which cause a large cause the mechanism to occupy floor space in the vehicle passenger compartment.

The platform and vertical drive in Braun can hinge or pivot through 90°. The platform remains horizontal, as necessary to support a wheelchair. When the platform is inside the van the wheelchair is rolled Ont. (or off of) the platform, for example in a direction perpendicular to the longitudinal axis of the vehicle. When the platform is outside the van, the user moves on or off the platform in a direction parallel to the longitudinal axis of the vehicle. This arrangement is effective for moving the vertically displaceable parts of the lift through the van doorway in either direction, with clearance when outside. However, in addition to occupying a good deal of space in the van, the mechanism blocks the doorway. Whether deployed or stowed, the mechanism and its rotational and vertical path require persons without wheelchairs to maneuver over or around the platform to pass through the doorway in a normal ambulatory manner.

Another form of wheelchair lift for a van is disclosed in U.S. Pat. No. 4,353,436—Rice et al. According to this arrangement, a linearly displaceable track and roller arrangement moves two vertically telescoping drive posts on opposite sides of the vehicle doorway, into the van or out of the van. When the drive posts are clear of the doorway, the platform can be lowered.

In U.S. Pat. No. 5,542,811—Vartanian, which is commonly owned with the present application, a wheelchair lift is mounted in a vehicle at one side of the doorway, for example at the front frame of a sliding side door of a van. A platform is positionable horizontally for carrying a wheelchair to be moved into or out of the vehicle. A vertical drive mechanism is attached to the platform at a corner adjacent the vehicle doorway, and has a hydraulic cylinder and chain drive raising and lowering the wheelchair relative to the doorway. A base member is attached to the vehicle inside the doorway on the floor. A carriage is carried on the base member for linear movement toward and away from the doorway. The vertical drive mechanism is coupled to the carriage on a vertical hinge or pivot axis that is movable by a linear actuator from a position at which the hinge axis is inside the vehicle to a position outside of the vehicle clear of the doorway. The platform can be raised, lowered and rotated on the vertical pivot axis. Since linear movement rather than rotation clears the doorway, a wheelchair occupant can move on or off the platform from a number of angles of approach between parallel to the longitudinal axis of the vehicle and perpendicular thereto. This device must be securely affixed to the vehicle to provide adequate strength without wobbling, particularly because the structure cantilevers the weight of the wheelchair and occupant relative to the base where it attaches to the vehicle. This device also substantially occupies the doorway and interferes with ambulatory passage.

Other wheelchair access assists are disclosed in U.S. Pat. Nos. 4,966,516 and 5,085,555—Vartanian. These devices involve segmented ramps that are folded in segments for stowing, or are unfolded for wheelchair access. The ramps are not powered and the assistance of a party on the ground is needed to deploy and to stow the ramp. To clear the doorway for a person to walk through, the '516 patent comprises means for pivoting the folded platform on a vertical axis in the manner of a gate. Whereas the structure used for rolling into or out of the vehicle is a simple and relatively lightweight folded ramp, the hinge structure need only support the weight of the two ramp segments. These segments are made of a relatively light openwork grid structure, and when the ramp is extended the segments are supported on the ground and on the sill of the doorway, rather than on the hinging structure. Additionally, the latching arrangement operates only as a gate latch that prevents the segments from hinging or swinging open, and does not support their weight.

U.S. Pat. No. 5,261,779—Goodrich discloses a powered platform arrangement that does not pivot clear of the doorway, but is lifted into position in the doorway or lowered to the ground by a parallelogram linkage that holds two carrying arms in a vertical position. The platform is pivoted on a horizontal axis to the vertical arms. As in certain of the foregoing known lifts, the device is heavy and complicated, or cannot be used or stowed compactly, or interferes with free access through the doorway for unassisted passage of the wheelchair occupant.

It would be advantageous to provide a wheelchair lift structure that has many of the advantages that are achieved individually in one or more of the foregoing patents. However each of the prior art structures achieves the advantages at the cost of corresponding drawbacks, and it has not been shown how one might achieve all the advantages in one structure. It would be particularly advantageous, for example, to provide a compact wheelchair lift that does not use a great deal of interior space, can be moved clear of the doorway, that positions the load in a cantilevered manner rather than on a long ramp, that can be used unattended by a wheelchair occupant, and that is durable in its structure, attachment and use.

SUMMARY OF THE INVENTION

It is an object of the invention to provide a parallelogram mounting capable of raising and lowering a wheelchair lift platform smoothly under power, in either direction between the ground level and the level of a vehicle passenger compartment.

It is an object of the invention to provide such a lift with a horizontal axis hinging mechanism that positions a platform horizontally for a wheelchair or other load and to hold the load in a cantilevered fashion at a space from the passenger compartment, where the load can be raised or lowered between the passenger deck and the ground. It is a further object in such a device where the load platform can pivot upwardly, to permit the folded-up platform to hinge clear of the vehicle doorway like a gate panel. This requires a structure for locking the hinged platform that can support a very substantial load.

It is also an object of the invention to optimize aspects of the vehicle wheelchair lift mechanism such that the device is effective for transport is durable, compact and minimally intrusive on use of the vehicle doorway in a conventional manner.

It is another object of the invention to provide a lift as described, with means for guiding, driving and locking and unlocking elements of the platform to enable powered relative movement in at least some of the respective manners mentioned, and also without undue complexity or increase in weight and bulk to provide safety gates and barriers, alignment adjustments and speed adjusting devices for customizing the mounting and operational particulars to the user's requirements.

These and other objects are accomplished by a wheelchair lift mounted in a vehicle doorway. The platform part of the wheelchair lift can be raised and lowered around a horizontal pivot axis, into a stowed vertical position, and in that position can be rotated around the vertical hinge axis to clear the vehicle doorway for normal access without climbing over the platform.

A mounting structure having laterally-spaced fixed vertical posts is rigidly mounted in the vehicle doorway, inside the innermost (closed) position of the vehicle door. The mounting structure comprises vertical posts, preferably extending from the floor to the roof, with an upper header beam and a lower horizontal base member that frame the doorway together with the posts. Laterally spaced vertical movable standards are attached to the fixed posts by parallelogram linkages and reside against the fixed posts in the retracted position of the lift. In the retracted position, complementary engagement structures engage between the vertical standards and the fixed posts. The engagement structures bear a lateral component of the load, and serve to position and align the vertical standards relative to the fixed posts. The engagement structures also define a stop position of the movable vertical standards as they are retracted against the fixed posts.

A wheelchair supporting platform is provided and has at least three distinct modes of movement that are effected sequentially for transferring a load in one direction or the other between the passenger compartment and the ground, or alternatively for clearing the doorway when the platform is stowed and not being used to carry a load. The platform is carried on parallelogram linkages holding the platform horizontal (when deployed) as the platform is raised or lowered between ground level and the level of the vehicle passenger compartment in one mode of movement. Preferably, this mode of movement is hydraulically powered and is adjustable. A variable throttle valve can be disposed in series with a drive cylinder for the parallelogram linkage drive to control the speed of movement.

The parallelogram linkages comprise at least two pivot arms hingedly attached between the fixed vertical posts and the movable vertical standards to form a parallelogram that ensures that the posts and standards remain parallel. The parallelogram defined by the linkage collapses flat when the standards are retracted inboard toward the posts and expands when the standards are deployed outwardly and downwardly to lower the lift. The load supporting platform is pivotable on a horizontal axis on the inboard side of the lift to permit the platform to be raised from a horizontal wheelchair carrying orientation to a vertical stored orientation (defining the second mode of movement). Inasmuch as the posts are fixed to the doorway of the vehicle in substantially a vertical orientation, and the standards are held substantially parallel to the posts due to the parallelogram linkage, the platform when open remains substantially horizontal as it is moved between the upper and lower load transfer positions.

For horizontal axis pivoting the platform is attached to the movable vertical standards on a horizontal hinge axis coupled to one of the vertical standards on a vertical axis journal post. On the side opposite from the journal post, a clamping latch attaches the opposite end of the horizontal hinge axis structure to the other vertical standard, bearing part of the load on the platform. Thus the platform can be pivoted into a vertical position where the platform is substantially in the plane of the standards. The standards are retractable via the parallelogram linkage back toward the posts that are rigidly attached to the vehicle on lateral sides of the doorway, thus collapsing the thickness of the overall mechanism.

Pivoting of the platform on its horizontal axis can be permitted or prevented by means of a latch for locking the platform against the standards, in an embodiment wherein the horizontal pivoting is not powered. Preferably, however, pivoting of the platform is driven in either direction by an linear actuator such that the gate is not dropped suddenly when deployed and can be pivoted into the stowed vertical position without manual assistance. A latch is not necessary in the embodiment in which the horizontal pivot is powered. A front roll-off gate, a rear roll-off gate, rear doorway barriers and side handrail members are linked to the respective parts and are arranged for automatic deployment and retraction as a function of the relative positions of such parts. More particularly, the rear roll-off gate is spring biased to retract and block the inboard edge of the platform, but is extended by a contact arm and roller that bears against the base of the fixed frame along the vehicle sill when the platform is placed against the sill to permit a wheelchair to roll on or off. In the retracted position, the rear roll-off gate is positively locked. An adjustment is provided to set the extent to which the rear roll-off gate opens when the platform is placed against the base of the fixed frame.

Similarly the platform has a roll-off gate on the outboard side that is spring biased to close and has a contact arm and roller that draw the gate open when the outboard edge of the platform meets the ground. This outboard gate preferably comprises a locking latch that drops over a portion of the outboard roll-off gate mechanism when the platform is raised above the ground and the outboard gate is closed (raised). In this manner the outboard gate is likewise positively locked unless the platform rests against the ground. It is not possible to open either the inboard or outboard roll-off gate even by rolling a wheelchair against them with some force, as might be possible if the roll-off gates were held closed by spring bias alone.

Unlike the inboard and outboard gates, which are opened or closed by contact between the platform in its horizontal position and one of the doorway sill (inboard) or the ground (outboard), the handrail members are pivoted via a connecting rod relative to the horizontal axis of the platform. When the platform is parallel to the standards (i.e., vertical) the handrail members collapse between the platform and the standards, and when the platform is moved perpendicular to the standards (i.e., horizontal), the connecting rod raises the handrail members to a position perpendicular to the platform.

Barriers to passage are movably mounted to the posts of the fixed frame in the doorway to block passage by protruding into the doorway opening when the platform has moved away from the doorway sill by operation of the parallelogram linkage. To accomplish this, one or more barrier members (preferably one on each lateral side) is coupled at a fixed post to a pivot pin or axis oriented parallel to the extension direction of the parallelogram linkage, and thus operable to guide the barrier gate(s) to a blocking position spanning the doorway or to rotate back around the pivot pin to a retracted position at the fixed posts or behind the fixed posts relative to the doorway opening. This motion is driven by connecting links coupled to the movable parallelogram linkage. A driving linkage is coupled between the barriers and the parallelogram linkage, such as a simple bell crank linkage.

The mounting of the barrier gates preferably has a lost motion feature. The barrier gates move from their retracted position to their extended or blocking position upon commencement of expansion of the parallelogram linkage (i.e., immediately after the parallelogram linkage starts to expand when moving the platform downwardly and/or away from the doorway sill). In their extended or blocking position the barrier gates rest against limiting pins that are fixed relative to the fixed posts and define the limit of rotation of the barrier gates around the pivot pins. At this limit of rotation the barrier gates preferably extend substantially horizontally across at least part of the width of the doorway opening, and at an elevation high enough to block a wheelchair from rolling through the doorway. The barrier gates occupy their blocking position when the platform is not abutting or very nearly abutting against the sill.

The barrier members are operated by couplings connected to other movable parts of the device, in particular to the parallelogram link members. The couplings are arranged to provide the correct leverage or mechanical advantage to move the barrier gates into their blocking position immediately after the platform begins to move away from the sill. As the couplings continue to advance with movement of the platform toward the ground, the barrier members are displaced relative to the coupling that drives them, over a span of lost motion. Additionally, the barrier members are attached to the couplings through at least one spring, such that the barriers can be displaced safely through the span of lost motion and against the bias of the spring, if the advancing barrier members encounter an obstruction when moving into the blocking position.

For this purpose, each barrier gate has a hub mounted on a pivot pin fixed to the gate-like frame members, and around which the barrier gate and the hub rotate. The hub has a bell crank arrangement or eccentric coupling fixed to the associated movable member of the parallelogram linkage so as to transfer linear motion of the movable member to rotation of the hub on the pivot pin. The barrier gate is also rotatable on the pivot pin but is attached to the hub by a spring such as a helical spring. A stop spaced from the pivot pin defines the limit of advance of the barrier gate. The bell crank coupling rotates the hub as the platform moves away from the sill, thus moving the barrier gate by its spring connection with the hub, from a retracted position to an advanced position against the stop. As the platform moves further toward the ground, the hub continues to rotate but the barrier gate remains against the stop over the span of lost motion. Over the span of lost motion, the spring is displaced (e.g., the helical spring is wound more tightly). When the platform is later moved from the ground toward the doorway sill, the barrier gate remains in the blocking position against the stop (unwinding the spring) until the platform nearly abuts the sill, whereupon the barrier is rotated around the pivot pin by its spring connection with the hub, and moved back into the retracted position.

The roll-off gates raise on the inboard and outboard sides to prevent a wheelchair from moving onto or off of the platform except when the platform rests either against the sill on the inboard side or on the ground or other horizontal surface on the outboard side. The roll-off gates are preferably operated by contact with the sill or the ground, rather than by any coupling with the movable parts of the parallelogram linkage.

A number of variations are possible and will be apparent from the following discussion of practical examples and preferred embodiments as illustrated in the drawings.

BRIEF DESCRIPTION OF THE DRAWINGS

There are shown in the drawings certain exemplary embodiments of the invention as presently preferred. It should be understood that the invention is not limited to the embodiments disclosed as examples, and is capable of variation within the scope of the appended claims. In the drawings.

DETAILED DESCRIPTION OF THE PREFERRED EMBODIMENTS

Figure 1:
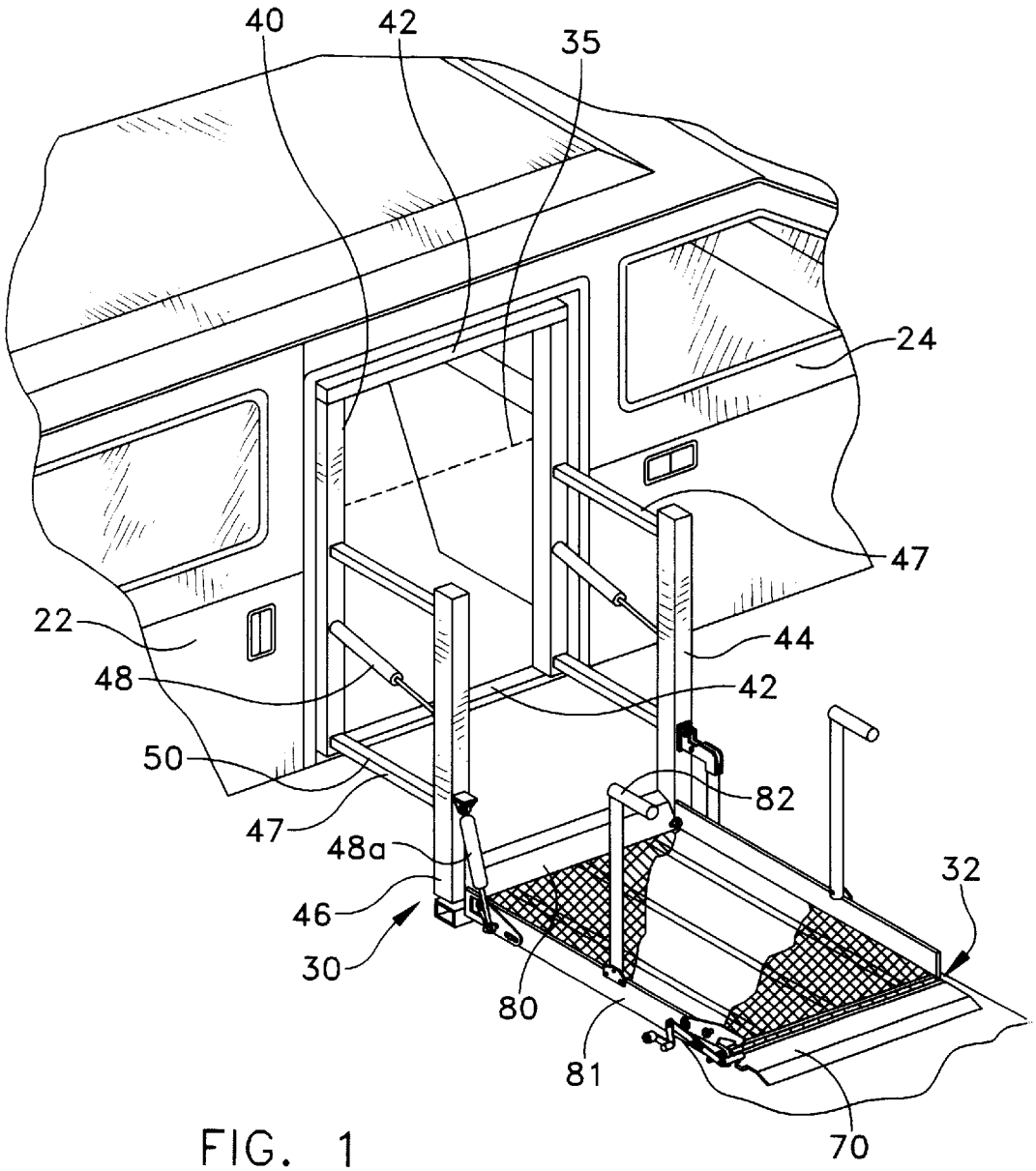
FIG. 1 is a perspective view showing the lift of the invention in a lowered position, mounted for example at the sliding side door of a van.
Figure 1A:
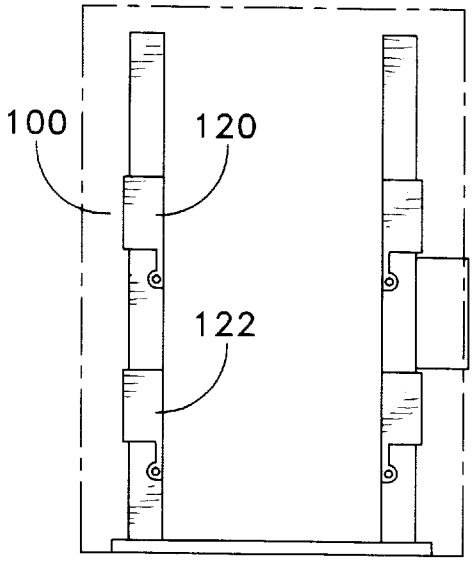
FIG. 1*a* illustrates the rear barrier arms of the invention in their vertical stowed positions.
Figure 1B:
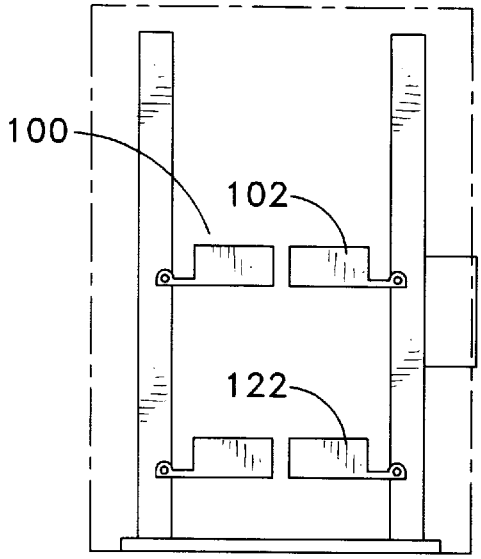
FIG. 1*b* illustrates the rear barrier arms in their horizontal deployed positions.
Figure 1D:
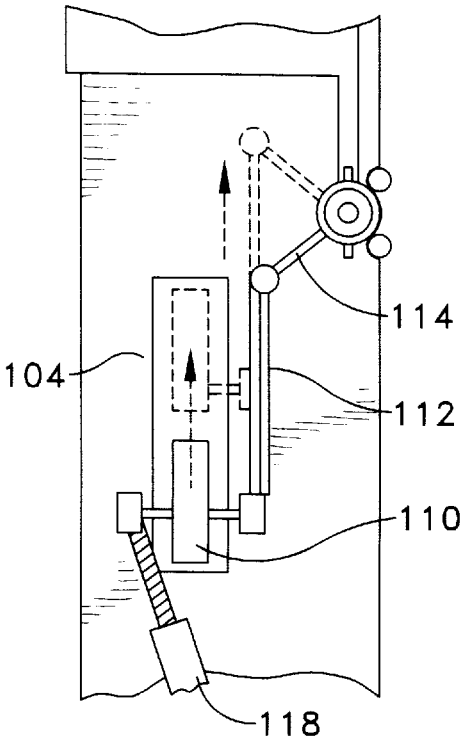
FIG. 1*d* is a detail elevation view corresponding to FIG. 1*c* and showing the upper linkages of the rear barrier mechanism.
Figure 1C:
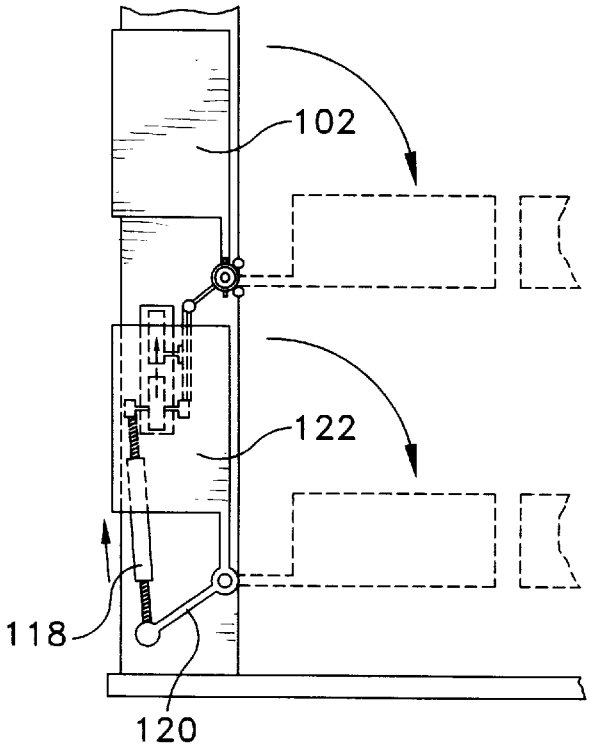
FIG. 1*c* is an elevation view showing the linkages of the rear barrier mechanism.

FIG. 1 shows the area of the side door 22 of a van 24, with the lift 30 of the invention in its lowered position as needed for a wheelchair (not shown) to be rolled on or off the platform 32 of the lift between the platform and the ground, e.g., a street or sidewalk. In the arrangement shown the wheelchair rolls onto or off of the platform in a direction perpendicular to the longitudinal axis 35 of van 24. The invention is also applicable to other types of doors and vehicles, for example a pivoting door rather than a sliding one, a rear door, etc.

In FIG. 1, a mounting structure having laterally-spaced fixed vertical posts 40 is rigidly mounted in the vehicle doorway adjacent the opposite sides of the opening defined by the doorway. The mounting structure locates the elements of the lift mechanism inside the passenger compartment and clear of the innermost (closed) position of the door when stowed. When stowed, the platform 32 is pivoted upwardly from horizontal to vertical and the parallelogram linkage members 47 draw the movable vertical standards 44 upwardly and inwardly toward the passenger compartment, where standards 44 rest against and engage with fixed posts 40. Thus when stowed the vertically oriented platform, retracted vertical standards and fixed posts are sandwiched against one another in a compact nearly coplanar arrangement across the opening of the doorway immediately inside the closed position of the exterior door. This arrangement is compact and occupies minimal space inside the passenger compartment. Furthermore, in the vertical position of platform 32, the platform can be hinged or swung on a vertical axis in the manner of a gate as discussed more fully below, to clear the doorway for passage in a normal ambulatory fashion.

The mounting structure comprises vertical fixed posts, preferably extending substantially from the floor to the roof and securely attached at their ends to frame elements of the vehicle, and can be affixed, for example, to the "B" and "C" posts of the vehicle, which frame the doorway. Upper and lower horizontal beams 42 can be attached to the fixed posts 40 to complete framing of the doorway opening on all four sides. The vertical posts in the embodiment shown are spaced slightly less than the full width of the doorway opening to provide room for the movable parts of the lift to pass through. The vertical posts can conceivably span only part of a particularly wide doorway, for example the space behind one panel of a two-panel door and the platform is movable between its horizontal load carrying position and its vertical stowed position.

The fixed vertical posts 40 support laterally spaced movable vertical standards 44, which in turn carry the platform 32 on which the wheelchair is carried. The movable standards 44 are carried by parallelogram linkages 47 driven by one or more hydraulic cylinders 48, which extend or retract the lift by expanding or contracting the parallelogram defined by four members pivotally connected at spaced points such that opposite members are parallel. In the embodiment shown, at least a length of the vertical standards 44 and a corresponding length of fixed post 40 are parallel and connected by spaced parallel pivot arms 50. The two spaced pivot arms 50 remain parallel to one another and the vertical standards 44 remain parallel to posts 40. Posts 40 which are mounted substantially vertically in the vehicle, and thus standards 44 are held vertical. The movable standards 44 abut against the fixed vertical posts 40 in the most retracted position of the lift 30 and can be spaced from the fixed posts, at most, by the distance between the pivot points with pivot arms 50, which guide the vertical standards in an arc around the pivot connections between posts 40 and pivot arms 50.

Preferably, platform 32 is pivoted by a linear actuator motor 48*a,* e.g., having a screw drive and nut mechanism driven by an electric motor, while the lift is raised and lowered by one or more hydraulic cylinders 48. One or more hydraulic or pneumatic cylinders can be provided to absorb energy from the weight of platform 32 as the platform is rotated downwardly, preventing the lift and the platform from crashing down due to gravity. Preferably, the lift is driven to raise or to lower on the parallelogram linkage by one or more hydraulic cylinders coupled to a hydraulic pump by suitable valving (not shown) controllable from the passenger compartment. A throttle valve that is preferably manually adjustable can be provided to restrict the rate of flow of hydraulic fluid so as to limit the speed at which the lift moves upwardly and/or downwardly. The speed of this movement can also be limited or cushioned in other ways such as by including energy-storing gas cylinders to offset a portion of the weight of the platform and/or lift, providing frictional or mechanical speed limiters, a dashpot to cushion against impact, etc.

The hydraulic drive cylinders can be coupled to drive the movable parts in one direction (i.e., to lift them) and to restrict the speed by throttling flow of hydraulic fluid only in the other direction (i.e., when dropping by gravity) by suitable check valves. The hydraulic cylinders can be coupled between the movable parts, particularly of the parallelogram linkage, at alternative positions in a known manner such that the cylinders raise the lift or pivot the platform upwardly by elongation or by retraction of the cylinder. In any event, vertical standards 44 and the supporting platform thereon are movable up or down in a curving arc.

The cylinders 48 can be self-contained hydraulic types coupleable to a hydraulic pump (not shown). The hydraulic pump could power all the aspects of the lift, but in a preferred embodiment powers the parallelogram linkage movement but not the pivoting of the platform on its horizontal axis, which is driven by an electric linear actuator. The hydraulic pump can be a dedicated pump driven by an electric motor (not shown) using electrical power from vehicle 24. In a vehicle with an existing hydraulic system (not shown), the cylinders 48 can be coupled to such system by suitable control valves (not shown).

The preferred lift mechanism provides at least three distinct modes of movement. These concern (1) deploying or stowing the platform by pivoting the platform on a horizontal hinge connection relative to the vertical standards, namely upwardly (to stow) or downwardly (to deploy); (2) moving the deployed platform up or down between the vehicle floor level and the ground by expanding and contracting the parallelogram to move the vertical standards in an arc relative to the fixed posts; and (3) hinging the vertically stowed platform (preferably outwardly) on a vertical hinge axis located at one of the vertical standards to unobstruct the doorway, or hinging the platform back between the vertical standards where the platform is locked in place by a latch.

Thus in one mode of movement, best illustrated in FIG. 1, the platform is carried in a horizontal orientation on parallelogram linkages 47 as the platform 32 is raised or lowered between ground level and the level of the vehicle passenger compartment by expansion or collapse of the parallelogram coupled posts, standards and pivot arms. This mode of movement is powered at least for raising the platform. For lowering, a down-solenoid valve can bypass the motor. The parallelogram linkages 47 in the embodiment shown comprise at least two pivot arms 50 on each lateral side of the platform, hingedly attached between the fixed vertical posts 40 and the movable vertical standards 44 to form the parallelogram that collapses when the standards 44 are retracted inboard and expands when the standards 44 are deployed outwardly and downwardly to lower the platform 32. One or more extendable/retractable hydraulic cylinders 48 can be placed between the two pivot arms 50 for smooth and gradual downward translation of the platform 32. In the embodiment shown, two hydraulic cylinders 48 are employed to raise and lower platform 32. The cylinders 48 are connected between corresponding fixed and movable standards on either side of the lift and when extended cause the pivot arms 50 to rotate downward, thereby lowering the movable standards and attached platform 32.

Figure 2:
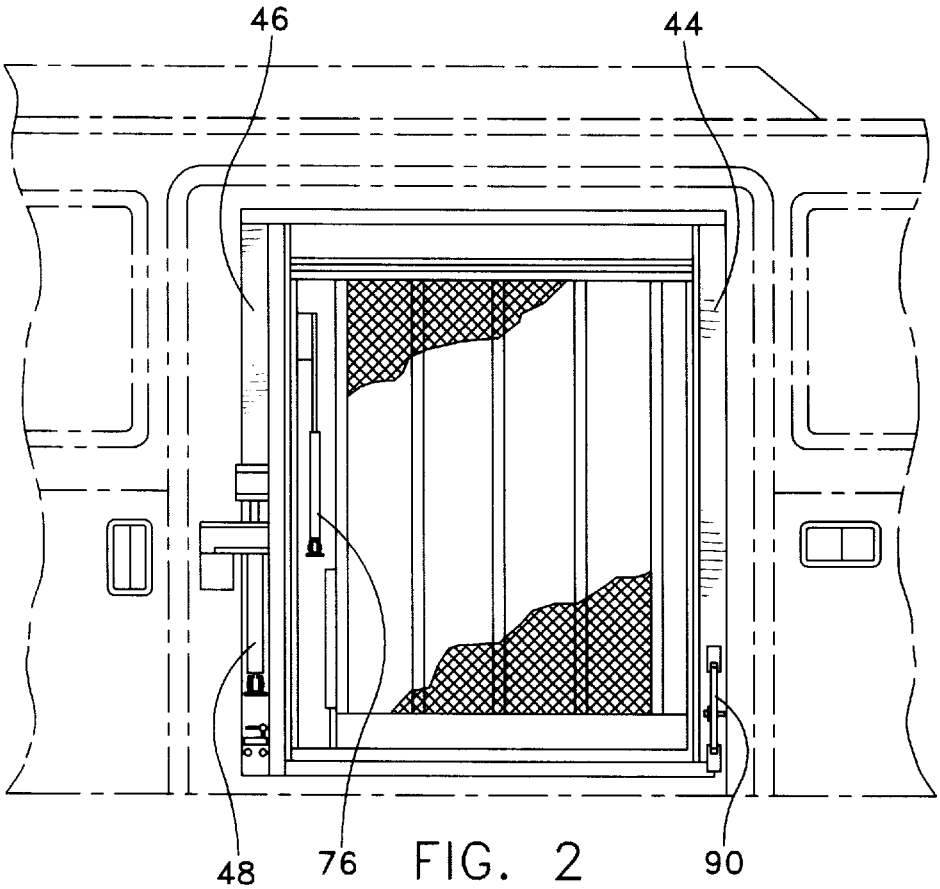
FIG. 2 is a side elevation view into the doorway, showing the platform of the invention in the vertical stowed position.
Figure 4:
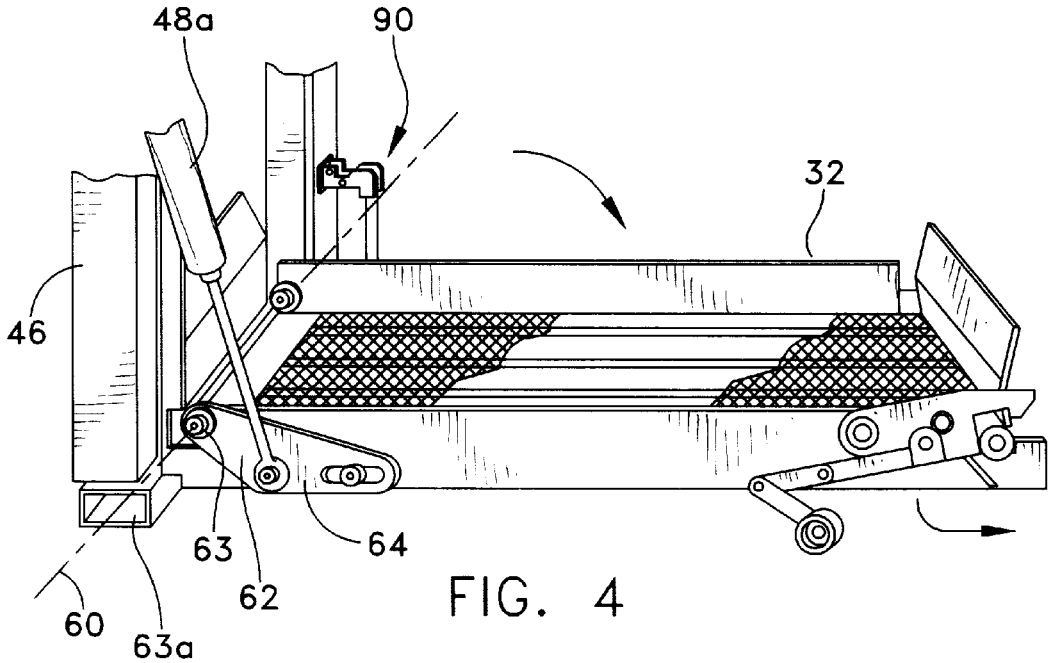
FIG. 4 is a perspective view showing the platform deployed and movable from its vertical stowed position to its horizontal wheelchair carrying position.

Referring to FIG. 4, in the second mode of movement, the platform 32 is pivotable on a horizontal hinge axis 60 to permit the platform 32 to be raised from a horizontal wheelchair carrying orientation to a vertical stored orientation. The platform 32 is attached to the movable vertical standards 44 on a horizontal hinge axis 60 extending between the standards 44, whereby the platform 32 can be pivoted into a vertical position in the plane of the standards 44 for stowing. FIG. 2 also shows the platform 32 in the vertical stowed position. In its vertical position, platform 32 occupies minimal space or thickness and thus space taken up by the lift inside the vehicle passenger compartment is minimized.

Figure 8:
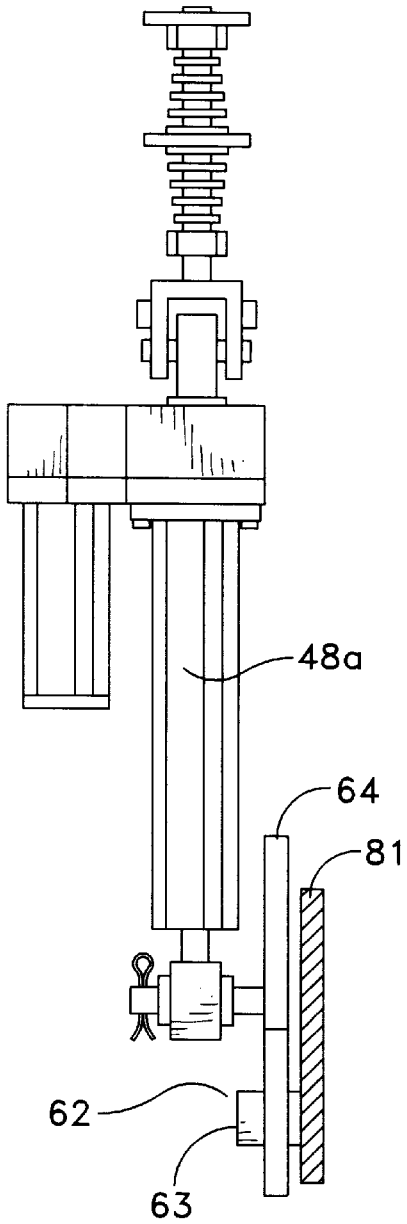
FIG. 8 is a detail elevation view showing the combination of the linear actuator and the horizontal pivot arm assembly.
Figure 7:
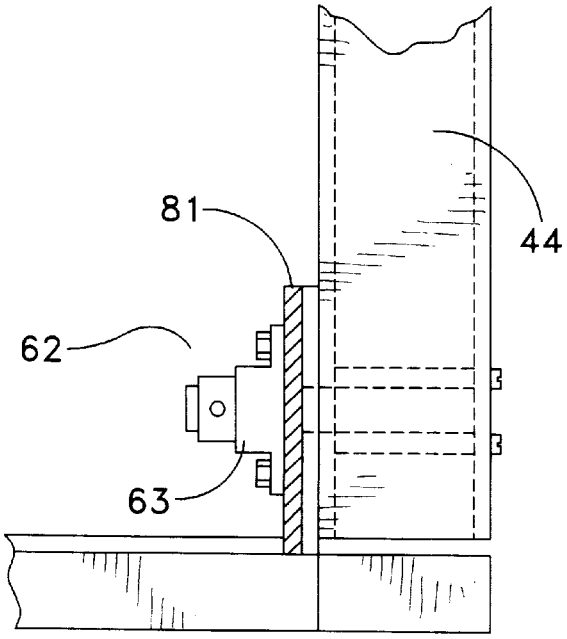
FIG. 7 is an elevation view of a typical horizontal hinging mechanism of the invention.

FIG. 4 shows horizontal hinge bearing 63, attached to a hinging base 63*a*, which is attached to the movable vertical hinge standard 46. Specifically, base 63*a* is mounted to one vertical standard on a vertical journal post (see FIG. 6), and to the other vertical standard by a clamping latch (see FIGS. 5*a*, 5*b*). Specifically, a supplement arm or whale 64 driven by linear actuator 48*a* moves the platform. Bearing 63 can be affixed to standard 46, for example by a welded bracket. The whale 64 is attached to the platform side wall 81 by a pin on the platform slidable in a slot in the whale 64. As shown in FIG. 8, the whale 64 is also attached to the rod end of the actuator motor 48*a*, which prevents the platform 32 from dropping abruptly to its lowermost position during its downward rotation and drives the platform in the lifting direction. As the rod of the actuator motor 48*a* is extended, arm 64 rotates platform 32 from a vertical to a horizontal position. The point of the connection of the rod end of actuator 48*a* to supplementary pivot arm 64 as shown in FIG. 4 is at the same elevation as the sliding pin on the lowered platform. However the connection of arm 64 is on the outboard side (or below in FIG. 4) of a line between the main hinge bearing 63 and the sliding pin. As a result, when actuator 48*a* is retracted to its shortest length when lifting platform 32, the sliding pin is brought over to the inboard side of main bearing 63. Thus the platform passes slightly toward the inboard side of vertical, and tends to stay stowed.

Typical mounting and adjustment parts, such as a clevis, springs and an alignment guide, are used to attach the working end of the actuator 48*a* to the whale 64. Horizontal hinge bearings 63 are provided on both lateral sides of the platform and define a horizontal hinge axis for the platform relative to the movable vertical standards 44, namely through the platform side wall 81.

Platform 32 could be arranged to be pushed outward manually on its horizontal hinge mechanism 63. However, this can be difficult to control by a person within vehicle 24 and requires an attendant on the outside to return the platform to its upright stowed position. For automatic and unattended operation, these movements are preferably powered by a linear actuator motor 48*a*, although the pivoting action of platform 32 can also be powered and/or speed regulated by inclusion of throttle valves in series with hydraulic driving cylinders. A hydraulic cylinder arrangement can be employed to draw platform 32 upwardly and to allow it to pivot downwardly. The hydraulic cylinder would also serve to absorb the energy of the platform when the platform is rotated downwardly, preventing it from crashing down and the speed is thereby adjustable as desired.

Linear actuator motor 48*a* can be preloaded somewhat to urge the platform 32 to rotate inwardly (i.e., up) when in the up position, for example by means of a spring or a gas cylinder (not shown) that stores energy to offset part of the weight of the platform. As discussed above, due to the supplementary pivot arm 64, in the stowed or up-position of platform 32, the platform preferably leans slightly inboard of precisely vertical, which aids in the stability of the platform 32 when stowed and prevents rattling and the like that could result from balancing the platform vertically.

In the third mode of movement, the platform 32 is hingeable relative to the movable vertical standards 44 carrying the platform 32 and the parallelogram linkages 47. Platform 32 is hinged in the manner of a gate relative to standards 44, on a vertical hinge axis 45. Preferably, the platform 32 is hingeably moved in this manner only when retracted to vertical. However, the platform is carried on a heavy duty journal post on the movable vertical standard on one lateral side, and is attached to the opposite movable vertical standard by a heavy duty clamping latch. The journal post (alone) can support the platform when hinged open. The journal post and the clamping latch together support the platform when hinged closed.

Figure 3:
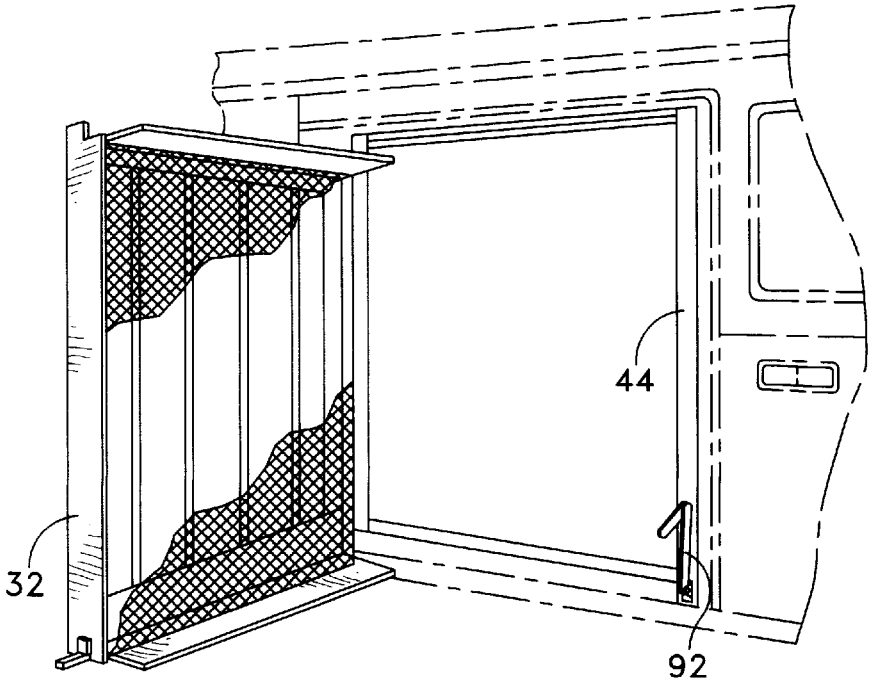
FIG. 3 is a perspective view of the lift, showing the platform swung clear of the doorway of the van.
Figure 6:
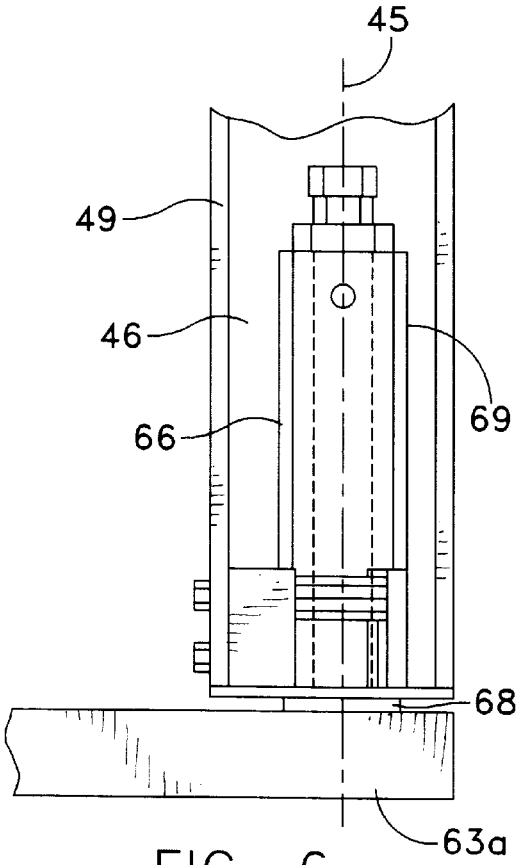
FIG. 6 is an elevation view of a typical vertical hinging mechanism of the invention.

The movable vertical standards 44 are mounted to the fixed vertical posts 40, by the two parallelogram linkages 47, and the vertical hinge arrangement permits the platform 32 to hinge like a gate. The hinge or journal arrangement is shown in FIG. 6. The journal post as shown is located at the lower end of the inside of channel flanges 49 of movable vertical hinge standard 46. Platform 32 can thus be hinged or rotated to clear the doorway for access, as generally shown in FIG. 3. As shown in FIG. 6, a typical vertical hinging mechanism 66 consists of a hinge bearing 68 inside an elongated piece of pipe 69, the elongated pipe design providing the structural strength of the vertical hinging mechanism. FIG. 2 shows the platform 32 rotated to its vertical stowed position across the doorway.

Figure 5A:
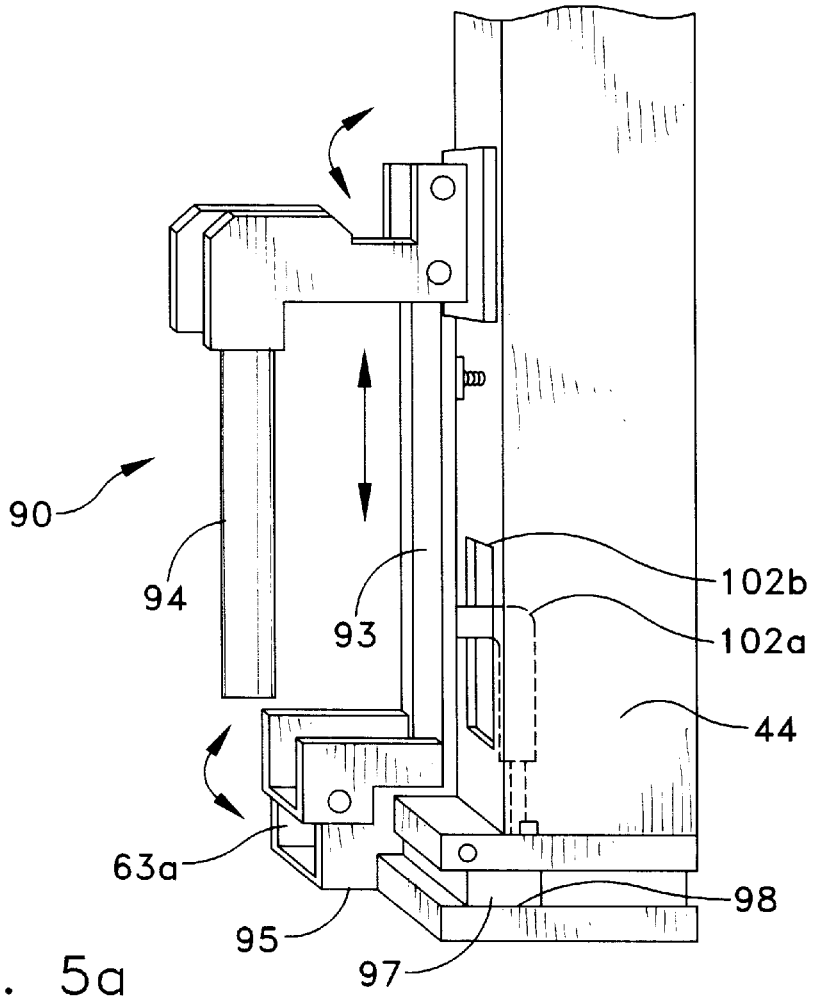
FIG. 5*a* is a perspective view showing the latching mechanism which allows the platform to be locked at the bottom of the vertically movable standard opposite from the standard at the vertical axis journal mounting.
Figure 5B:
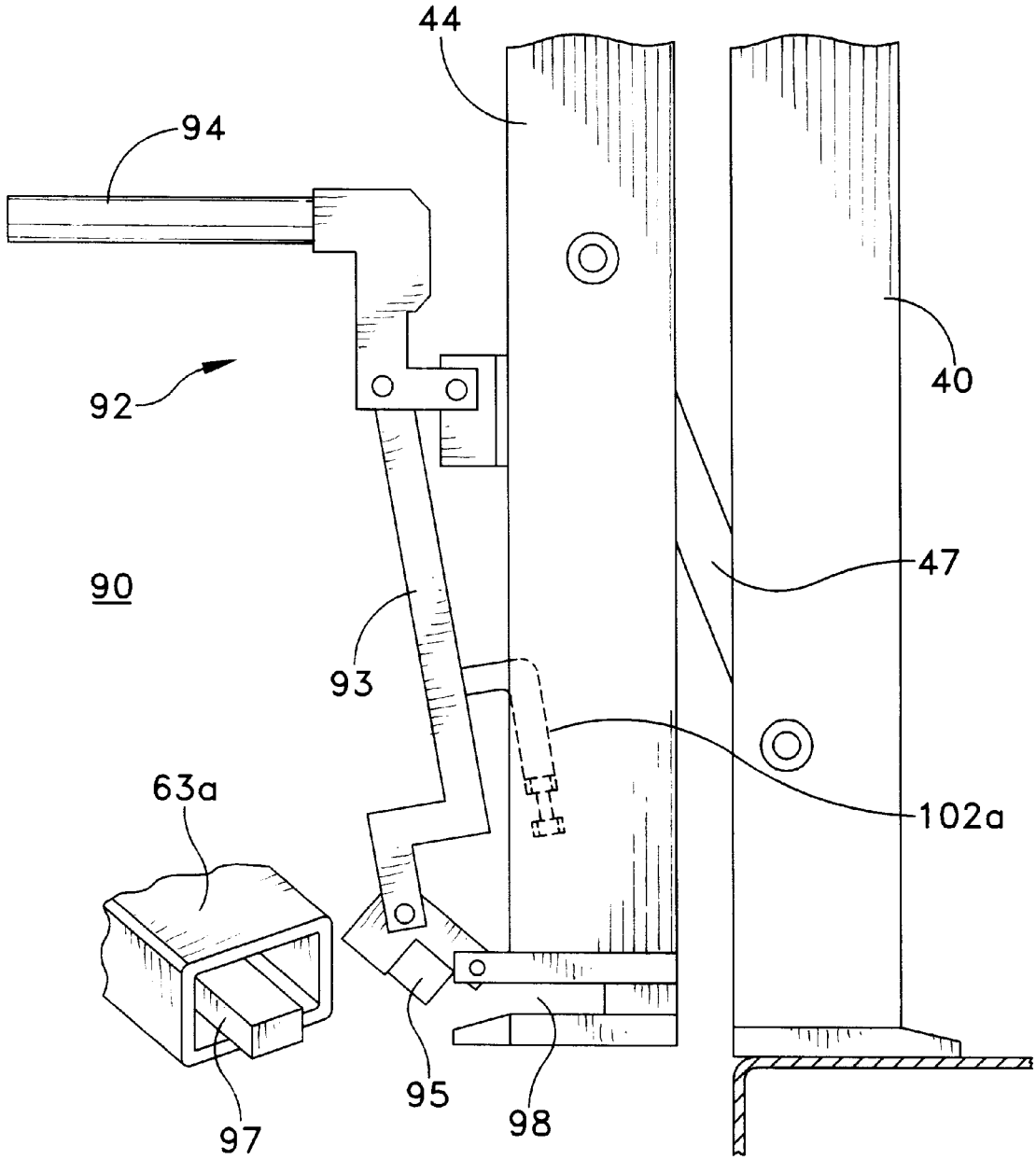
FIG. 5*b* is an elevation view corresponding to FIG. 5*a,* showing the relationship of the fixed posts, parallelogram linkage members, movable vertical standards and gate-like hinging of the folded-up platform.

FIGS. 5*a* and 5*b* show a secure clamping latch mechanism 90 by which the side of the platform opposite from the journal posts is locked to the movable vertical standard on that side when hinged across the doorway, thereby affixing the platform to the spaced movable vertical standards on both opposite sides. This latching mechanism 90 allows the platform 32 to be locked to the vertical standards, preferably when in the vertical stowed position. When disengaged, the latch mechanism 90 permits pivoting of the platform about the vertical pivot mechanism 66, shown in FIG. 6.

Figure 12A:
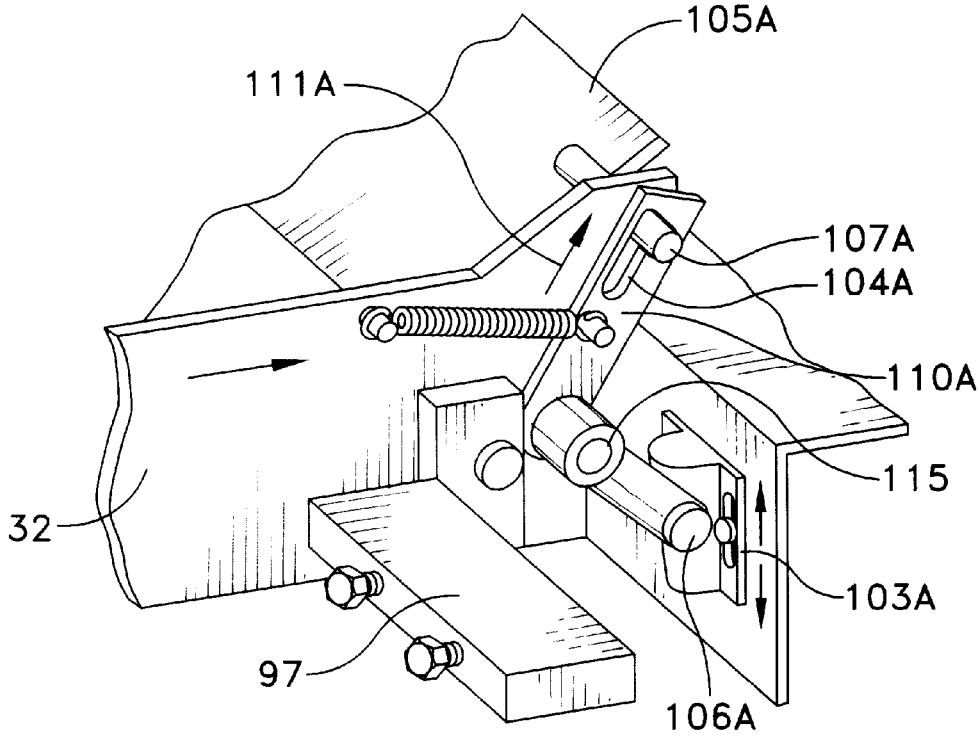
FIG. 12*a* is a perspective illustration of the inboard roll-off gate, shown closed.
Figure 12B:
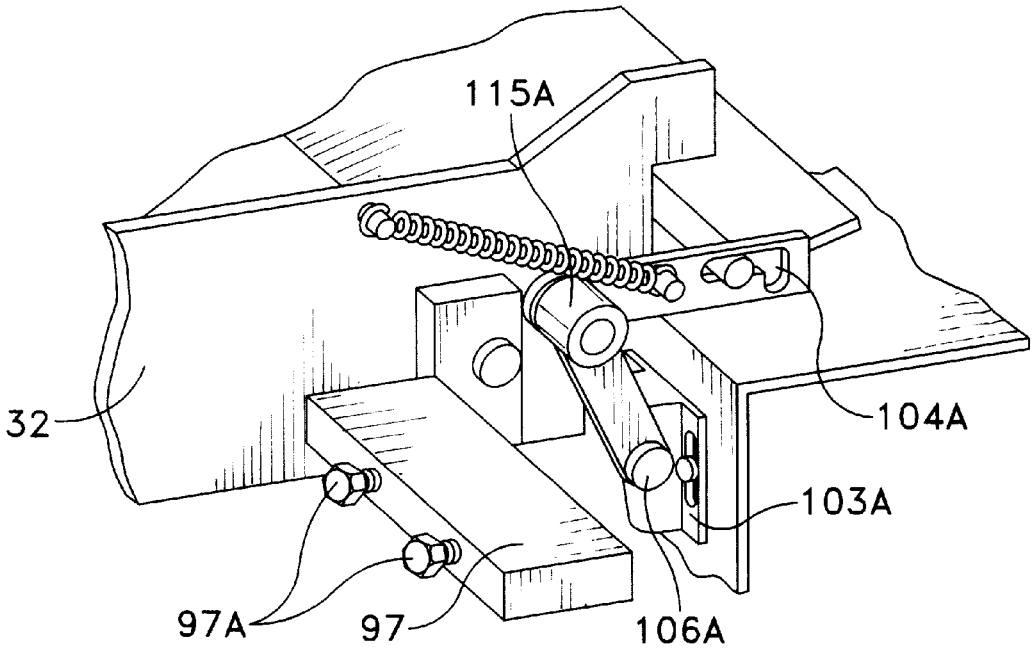
FIG. 12*b* is a perspective view corresponding to FIG. 12*a* with the inboard roll-off gate shown open.

As shown in FIGS. 3, 5*a*, 5*b*, the latching mechanism 90 consists of a latching arm 92 which is attached to the movable vertical standard 44 at a pivot point, the latching arm being movable by handle 94 and providing leverage or mechanical advantage. FIGS. 5*b*, 12*a*, 12*b* show details of the latch mechanism. A protruding bar 97 is attached to the platform 32, specifically protruding from the base tubing member 63*a* (see FIGS. 4 and 5*a*) to which the platform is attached on a horizontal axis. Tubing member 63*a* is the member that carries the platform (which also pivots up and down), while hinging on vertical axis 45 via the journal mounting shown in FIG. 6. A structurally sound connection is needed at the journal mounting to support the weight of the platform when hinged open around axis 45. A structurally sound mounting is also needed at the end of base tubing member 63*a* that is opposite from the journal mounting, to adequately support the platform when pivoted up and down. The latch mechanism (FIG. 5*b*) provides a robust and structurally supportive connection.

A protruding bar 97 is welded to base tubing member 63*a* and pivots together with the base tubing member 63*a* and the platform pivoted thereto, around hinge axis 45 in the manner of a gate. Protruding bar 97 provides a tenon-like member at the free end of this gate that is received in a clamping keeper mechanism in FIGS. 5*a*, 5*b*. For locking the platform in a position in which the lift can be deployed, the protruding bar 97 is received in the receptacle or keeper welded to the bottom of the movable vertical standard 44. An L-shaped clamping arm 102*a* is formed integrally with or affixed to a push rod 93 and is received in a vertical slot 102*b* formed in the front of vertical standard 44. As latching arm 92 is pushed downward manually, thereby lowering push rod 93 with some mechanical advantage, clamping arm 102*a* is caused to rotate inward and to move down along slot 102*b*. The bottom end of clamping arm 102*a* presses vertically downwardly against protruding bar 97 to secure bar 97 and base tubing member 63*a* in position by vertical clamping. At the same time, the downward movement of push rod 93 causes the rotatable contact member or pad 95 to rotate on its pivot (counterclockwise in FIG. 5*b* ). This causes contact pad 95 to bear horizontally inwardly against the protrusion of bar 97 from of base tubing member 63*a*. Clamping arm 102*a* is preferably length adjustable by a bolt and locknut as in FIG. 5*b*. Contact pad 95 can also be adjustable by providing a bolt or the like # 97A FIG. 12*b* to precisely set the point at which contact pad 95 bears against the protrusion of bar 97. By setting these adjustments at positions such that clamping arm 102*a* and contact pad 95 are both at their full extension against the protrusion of bar 97 at the point at which latching member 92 and manual operator 94 thereof are centered at their maximum downward position, latching member 92 can be forced over center into a stable and fixed locking position in which the protrusion of bar 97 and thus base tubing member 63*a* are solidly and structurally engaged at the vertical standard opposite from the vertical standard carrying the journal mounting.

To release platform 32 to hinge or rotate out of its position blocking the doorway, the latch handle 94 on the latching arm 92 is lifted (pulled outwardly in FIG. 5*a*). This raises an elongated push rod 93 and integral clamping arm 102*a*, and draws rotated contact pad 95 outward and upward from the receiving opening 98 for protruding bar 97, freeing bar 97 and allowing the platform to hinge out of the doorway on the journal post on the opposite side of the platform. Contact pad 95 is L-shaped and is pivoted above the opening 98 such that linear downward displacement of push rod 93 forces the L-shaped contact pad 95 to rotate (counterclockwise in FIG. 5*a*) and hold bar 97 tightly in opening 98. The clamping latch is shown open in FIG. 5*b*, namely with handle 94 pulled outward, raising push rod 93 and clamping arm 102*a*, and rotating contact pad 95 away from receptacle 98 to free bar 97. If the adjustments are precisely set as discussed above, pulling handle 94 outwardly requires exertion of force to pass through the dead center position of the linkage, whereupon handle 94 swings up freely and disengages clamping arm 102*a* and contact pad 95, allowing the folded-up platform, carried on base tubing member 63*a*, to swing out like a gate.

As generally shown in FIG. 1, a front roll-off gate mechanism 70, rear roll-off gate mechanism 80 and side handrail members 82 are linked for automatic deployment and retraction together with the platform 32 and the movable vertical standards 44 that carry the platform. Roll-off gate mechanisms 70 raise or lower to prevent a wheelchair from moving off the platform 32 except when resting on a horizontal ground surface. For example, as shown in FIGS. 9, 10, 11*a* and 11*b*, the front roll-off gate mechanism 70 has a biased latch 72 operable to keep the gate 71 raised when the platform 32 is not in contact with a horizontal surface, and is opened by contact with the horizontal surface.

Figure 9:
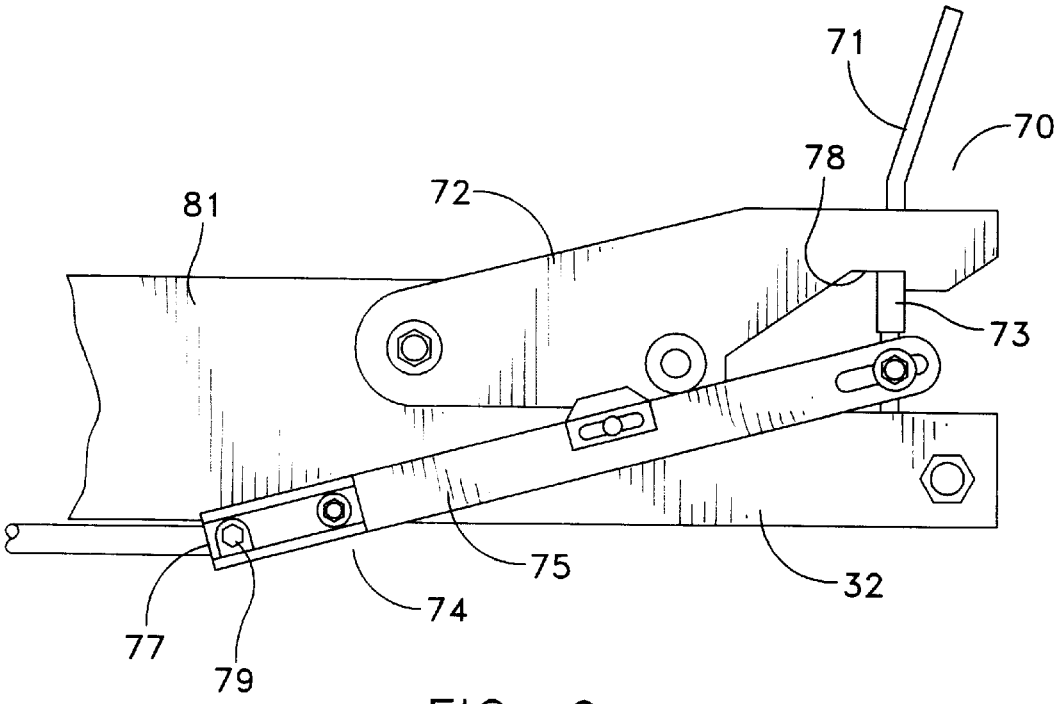
FIG. 9 is a detail elevation view showing the front gate mechanism closed.
Figure 10:
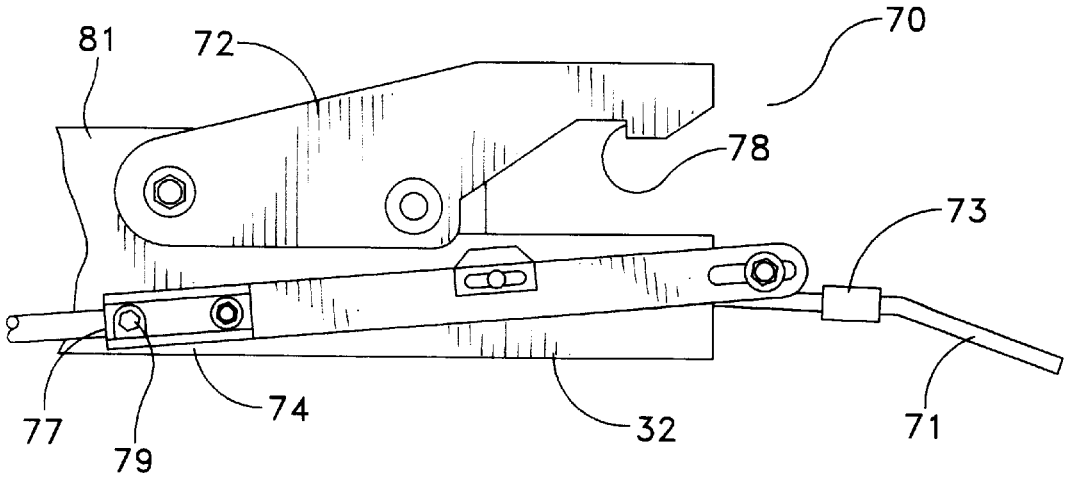
FIG. 10 is a detail elevation view showing the front gate mechanism open.
Figure 11A:
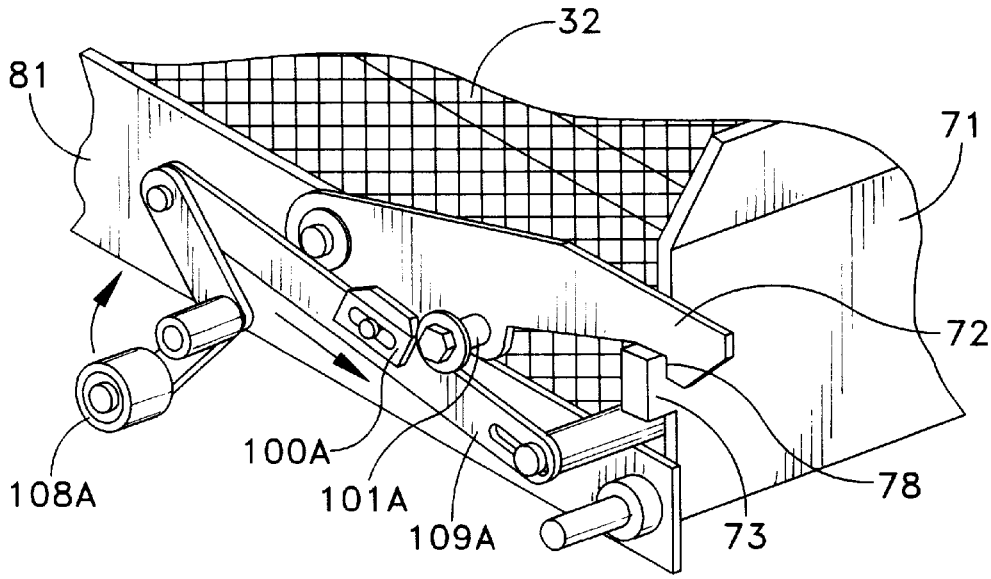
FIG. 11*a* is a perspective view showing an alternative embodiment of the outboard roll-off gate, shown closed.
Figure 11B:
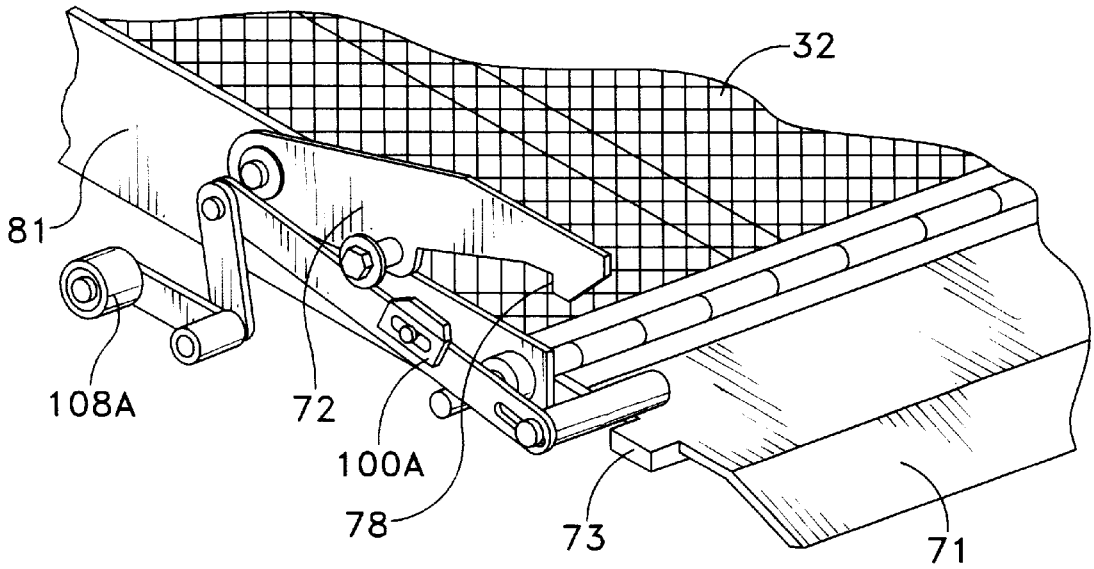
FIG. 11*b* is a perspective view corresponding to FIG. 11*a* with the roll-off gate opened by contact with the ground.

As shown in FIGS. 9 and 10, the gate 71 preferably is opened when force is transferred from contact with the ground (for the outboard gate) or the doorway sill (for the inboard gate). FIGS. 11*a* and 11*b* show the closed and open state of the outboard or ground-operated gate, and FIGS. 12*a* and 12*b* show operation of the inboard or sill-operated gate.

Referring to FIGS. 11*a*, 11*b*, the gate or blocking member 71 on the outboard side comprises a metal strip extending along the edge of the platform, hinged on a horizontal pivot axis and having a protruding end or tab 73 spaced radially from the pivot axis. When the gate is closed, the protruding end or tab 73 is captive under a safety latch dog 72 with a hook-like abutment 78 that drops over the protruding end or tab 73 to dog the gate 71 in the raised position, positively holding the gate closed when the platform is not resting against the ground. A positive latching mechanism is preferred over holding the gate only by spring bias, because a spring could be overcome by rolling against the gate with sufficient force, whereas the dogged latch cannot be overcome in that way. The gate or blocking member 71 is attached to a link bar 109*a* disposed at a space from the pivot pin engaging the flanged side of the platform. A roller member is mounted to the platform flanged side to rotate around another pivot pin, and the roller member is attached to the link bar 109*a* at the end opposite from its connection to the blocking member (gate) 71. When the gate is closed (FIG. 11*a*) a lateral protrusion 101*a* of the latch dog 72 rests over the link bar 109*a* and the latch dog abutment or stop part 78 engages the protruding end of the blocking member 71. As the platform is lowered to within approximately 3 inches of the ground, contact with the ground by roller 108*a* pivots the roller member clockwise on its pivot, advancing link bar 109*a*. Cam 100*a* pushes against roller 101*a*, which raises safety latch dog 72 to un-dog end or tab 73 of blocking member 71 of the gate. Advance of link bar 109*a* toward the opening direction of the blocking member 71 (FIG. 11*b*) causes blocking member 71 to open (rotate downwardly). Initially, the blocking member 71 remains stationary as an integrally formed pin rides to the back of a slot in arm 109*a*. When the pin reaches the back end of the slot, continued forward motion of link bar 109*a* rotates blocking member 71 about its hinged axis to open the gate for a wheelchair to enter or exit platform 32. In this manner the outboard gate is positively dogged shut when the platform is above the ground, yet opens easily when the ground is contacted by the roller.

For returning gate 71 to the closed position when roller 108*a* is no longer in contact with the ground, a torsion spring 120 can be operatively mounted on the pivot axis between the platform and gate 71, or a tension spring can be coupled to retract arm 109*a* in an inboard direction and thereby raise gate 71. In a preferred arrangement, a torsion spring having an elongated spring member is affixed at its opposite ends to the platform and to the hub of the linkage that carries roller 108*a*. The torsion spring is twisted with deflection of this hub.

To summarize, latch dog or member 72 with its dogging abutment 78 is pivoted to the side flange of the platform on the inboard side and has a roller 101*a* that is lifted by link bar 109*a* (and specifically by sloping edged cam 100*a* thereon) to raise the latch dog or member 72 and disengage dogging abutment 78 from dog-receiver end or tab 73 when contact with the ground pushes roller 108*a* upwardly. As soon as roller 108*a* encounters the ground, link bar 109*a* begins to advance in the direction of gate 71. However, link bar 109*a* has a slotted opening at which link bar 109*a* is attached to a pin protruding laterally from gate 71, at a space from the pivot axis of gate 71 along the edge of the platform. Link bar 109*a* advances in the direction of gate 71 far enough to move cam 100*a* on link bar 109*a* under roller 101*a* on or dog member 72 before the end of the slot in link bar 109*a* is reached. Thus latch or dog member 72 is lifted first, and as link bar 109*a* continues to advance beyond contact with the end of the slot, link bar 109*a* pushes gate 71 open. In the opposite direction when the platform lifts off the ground, spring 120 returns gate 71 upwardly as roller 108*a* allows link bar 109*a* to retract. Dog member 72 could be lifted by contact with cam 100*a* as link bar 109*a* moves in the retracting direction. Preferably, the facing end of dog member 72 has an inclined lower edge as shown, whereby protruding end or tab 73 lifts dog member 72 as end or tab 73 slides under the inclined lower edge of dog member 72. As end or tab 73 passes abutment 78, dog member 72 drops over receiver 73 and the roll-off gate is once more positively held in its raised position.

FIGS. 12*a*, 12*b* illustrate an alternative roll-off gate mechanism that is preferably employed on the inboard side of the platform. Gate 105*a* is also operated (lowered) by contact between the mechanism and a roller, specifically roller 106*a*, but in this case roller 106*a* is positioned to come into contact with a wedge shaped adjuster 103*a* that can be vertically displaced and fixed to set the lateral point at which roller 106*a* begins to be displaced to commence lowering of the gate 105*a*. Roller 106*a* is mounted on one end of an L-shaped link bar 110*a* which is secured to side wall of platform 32 by a pivot pin 115*a*. In this case a tension spring placed at a space from pivot pin 115*a* serves to return gate 105*a* to its raised position. Like the outboard gate, however, the mechanism has a positive stop against opening by a force from the platform side, as might occur if a wheel chair rolls against gate 105*a*.

As platform 32 moves inward (toward the van) when preparing to receive a wheel chair or when allowing a wheel chair on the platform to roll into the van, the roller 106*a* contacts adjuster 103*a* causing link bar 110*a* to rotate (clockwise in FIG. 12*a*) about pivot pin 115*a*, against the tension spring bias. The inboard side gate 105*a* includes an integral pin 107*a* which is received in an L-shaped slotted aperture 104*a* provided near the end of the link bar 110*a* on the side of pin 115*a* opposite roller 106*a*. As link bar 110*a* rotates clockwise, the portion of the link bar containing L-shaped slotted aperture 104*a* moves downward causing gate pin 107*a* to translate inside slot 104*a*, whereby the inboard gate 105*a* is lowered to provide access to and from the platform 32.

The link member 110*a* is coupled by a spring to the side flange of the platform 32, which in conjunction with springs around axis 60 provides sufficient force to retract the inboard gate to its closed position, as platform 32 moves away from sill 42. The inboard gate 105*a* is likewise retracted under the force of the springs when platform 32 is swung out of the doorway about its vertically hinged axis, causing roller 106*a* to pull away from actuator 103*a*. When inboard gate 105*a* is fully retracted, pin 107*a* comes to rest in the bottom of a short arm of the L-shaped slotted aperture 104*a*, which acts as a positive latch to secure the gate 105*a* in place (see FIG. 12*a*). If downward pressure is applied to inboard gate 105*a* in this position, the tendency of pin 107*a* to move outward will be prohibited, and the force of pin 107*a* against the wall of the slotted aperture will increase, causing the short arm of the slotted aperture to latch harder against the pin 107*a*. Thus, when the inboard gate 105*a* is retracted, link bar 110*a* provides a secure latch to prevent the gate from lowering, which can be released only by applying a force to roller 106*a,* and not by rolling a wheel chair against the gate.

As shown in FIG. 12*b,* the inboard gate 105*a* functions when open as a ramp or transition member between the platform and the interior of the passenger compartment above the sill.

Adjuster 103*a* is wedge shaped and can be moved vertically up or down with respect to the front of the doorway sill to set the limit the travel of the inboard side gate 105*a*. For example, moving adjuster 103*a* up will limit the downward movement of inboard gate 105*a.* Thus, the adjuster position can be set to ensure that inboard gate 105*a* will rest again sill 42, for smooth wheelchair transfer on and off the platform.

FIGS. 9 and 10 illustrate the operation of an alternative front gate mechanism 70, which comprises an actuator (not shown) attached to advance or retract contact arm 75. The front gate mechanism 70 comprises a horizontally pivoted gate or blocking member 71 coupled to one end of a contact arm or link member 75 on a side flange 81 of the platform. The opposite end of the link member is coupled to a bolt affixed to the blocking member. In this case the link member or contact arm is biased by a hydraulic, pneumatic or electrical actuator to pull the gate 71 into a blocking position (i.e., toward the left in FIGS. 9 and 10). Contact arm 75 has an end 77 opposite from the end attached to gate 71, that extends below platform 32 when the barrier is raised as shown in FIG. 9. When platform 32 contacts the ground, as shown in FIG. 10, contact arm 75 is lifted at the rear, thereby contacting and raising latch dog 72 so that the gate or barrier member 71 is freed and can be opened by advance of contact arm 75 to the right in FIGS. 9 and 10.

As shown in FIG. 9, when the gate 71 is raised to its blocking position, latch receiver 73 which is attached to the gate 71, is positively dogged by the latch dog 72 attached to the side flange wall 81 of the platform. Gate 71 preferably is returned to its closed (raised) position by a torsion spring or the like, but the spring only serves to return the gate and is not the operative mechanism that holds the gate closed. Gate 71 has an attached latch receiving end or tab 73 protruding parallel to the hinging axis of gate 71 and spaced from the hinging axis, which receiver is captured under the latch dog 72, specifically at abutment 78. If a wheelchair on the platform rolls against the gate 71 when raised, this abutment or end of slot 78 on the latch dog 72 positively blocks or dogs gate 71 from hinging open. This arrangement likewise provides a positive gate stop or closure, rather than a gate that can be opened with sufficient force against a spring (not shown) attached to exert a bias to close the gate.

The gate on the outboard side is enabled to open by contact with the ground. The gate on the inboard side can be arranged to open by lateral contact with the vehicle such as against the stepwell below the level of the floor of the passenger compartment. Alternatively the roller can contact the floor of the vehicle passenger compartment adjacent to the platform or the edge or lip between the floor and the side of the stepwell (not shown). Preferably the inboard gate opens by lateral contact with the side wall of the stepwell and begins to open as the platform approaches the edge of the passenger compartment and opening fully to define a transition or ramp between the passenger compartment and the platform when the platform is fully retracted by collapse of the parallelogram linkages.

FIG. 1 also shows a preferred side handrail structure. Side handrail 82 is hingedly attached to a platform side flange wall 81 on one end, and attached via a link member to pivoting base 63*a*. The handrails 82 are linked in this manner for automatic deployment and retraction together with the platform 32. As the platform 32 is lowered to its horizontal wheelchair-carrying orientation, the handrails 82 are rotated into an open positions extending vertically upward from the platform and having horizontally oriented handholds at the upper ends. As the platform 32 is rotated upwardly to its vertical stowed position, the handrails 82 likewise retract to their closed positions, folding between the platform sidewalls 81 and the fixed vertical posts 40.

Figure 1E:
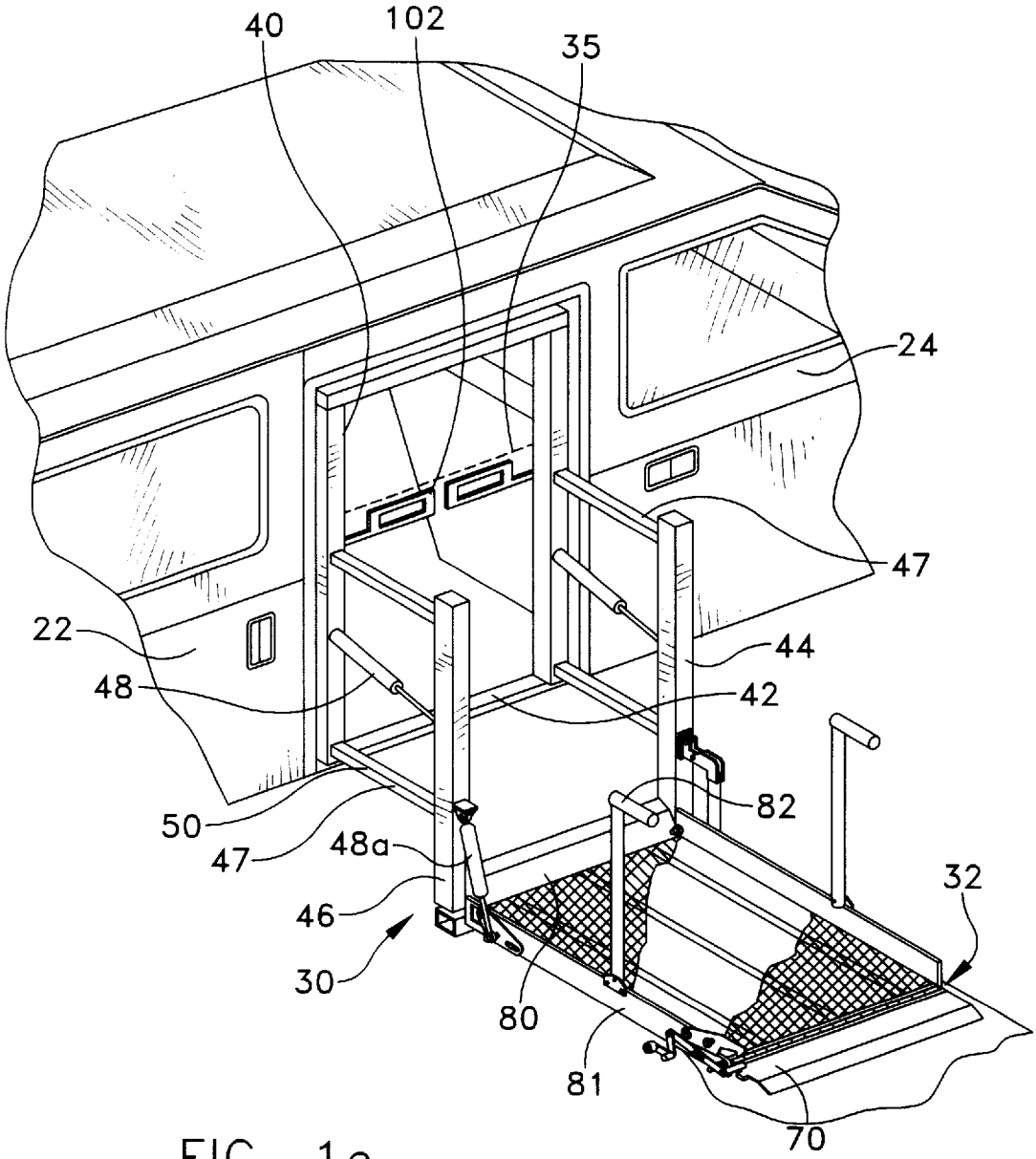
FIG. 1*e* is a perspective view corresponding to FIG. 1 and showing the lift with the rear barrier mechanism installed.

FIGS. 1*a* through 1*d* illustrate details of a multi-part access barrier gate that deploys automatically to place one or more barrier members across the opening of the doorway when the platform is moved downwardly. Several linkages 104 are provided to couple together four gate members (FIGS. 1*a*–1*c*) of the rear barrier mechanism 100 in the embodiment shown. The rear barrier preferably has at least one pair of barrier gates (FIG. 1*e*) obstructing passage when the platform is deployed (e.g., the upper ones 102 only). Alternatively this barrier can consist of a single barrier member, preferably large enough to obstruct a sufficient width of the doorway to permit a wheelchair to inadvertently roll through the doorway.

The rear barrier linkage mechanism can have a tension spring (not shown) for each movable barrier gate member, biased to rotate the respective barrier arm 102 into the advanced or obstructing position. Preferably the advance of the barrier arm is limited against a fixed stop pin protruding from the fixed vertical posts. When the lift is rotated downwardly by expansion of the parallelogram linkage, a stroke arm 110 coupled to a parallelogram pivot arm 50, is displaced upwards. Connecting member 112 couples this translation via a bell crank on a cam. Barrier arm 102 rotates part way around its mounting pin, and then abuts against a stop pin limiting its rotation to a position in which the barrier arm 102 obstructs the doorway, for example to a horizontal position. The cam arm 114 can rotate further until the stroke arm 110 meets the limit of its displacement, namely when platform 32 is at its lowest elevation. The parallelogram can be arranged to limit the downward displacement of platform 32 to the nominal elevation of the ground, but preferably has a lower limit that is somewhat below the nominally expected ground level, to accommodate uneven terrain such as might be encountered in attempting to discharge a passenger when the vehicle is at a curb level and the discharge point is the ground or other surface at a lower elevation.

When the wheelchair lift is retracted and the platform is lifted upwardly toward the stowed position, barrier arm(s) 102 stays in a substantially horizontal blocking position resting against the fixed stop, until the lost motion in the barrier arm mounting is taken up, preferably when the platform is part way to its retracted position, docked against the edge of the passenger compartment, for example a third of the distance.

Figure 13:
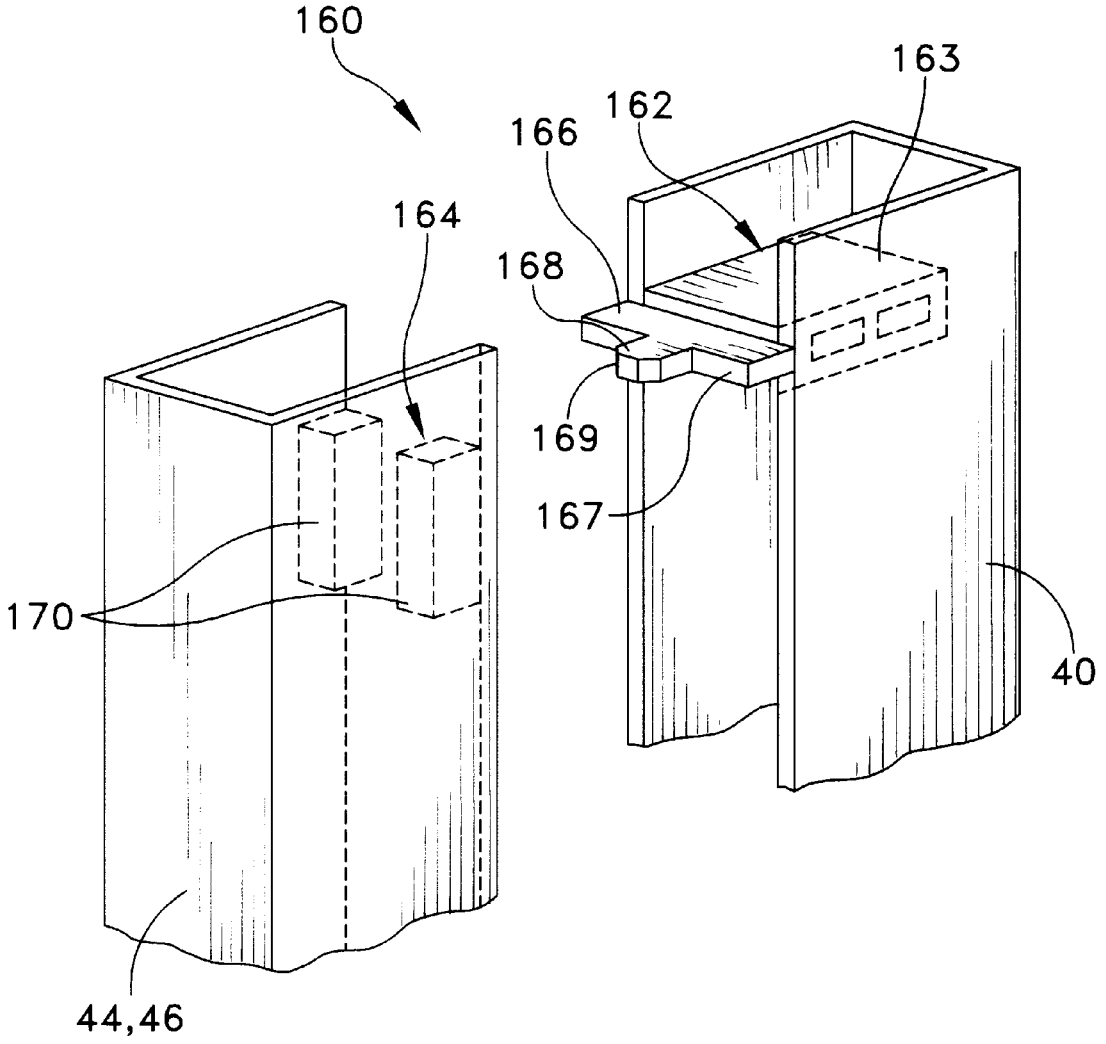
FIG. 13 is a partial perspective view showing the complementary engaging structures provided at each of four corners of the lift, for positioning and in part for supporting the vertical standards relative to the fixed posts.

FIG. 13 shows a frame stabilizer assembly 160 for maintaining proper alignment between the fixed and movable frames when the lift is in a retracted position and movable standards 44 abut the fixed vertical posts 40. Preferably, four stabilizers 160 are provided, one at the top and bottom of each vertical standard. Each stabilizer 160 includes a male assembly 162 being mounted to a fixed vertical post 40, and a corresponding female assembly 164 which is mounted to a movable standard 44, 46. The male and female sense of these parts can be reversed.

The male assembly 162 includes a bracket 163 that is secured to a fixed vertical post 40. A flange 166 is mounted to bracket 163 and includes a projection 168 that engages the spaced apart parts 70 of female assembly 164 when the lift is in a stowed position. The projection 168 includes chamfered edges 169 to facilitate the engagement of projection 168 with assembly 164. The flange 166 can be adjusted in or out with respect to bracket 164 to control the distance between the vertical posts 40 and movable standards 44 when the lift is in a fully retracted and stowed position, thus ensuring proper alignment of the movable vertical standards with the fixed vertical posts 40. This arrangement also provides lateral mechanical support.

This assembly provides for lateral support and defines a retraction stop position for movable vertical standards 44 relative to fixed posts 40. If the flange 168 of a stabilizer assembly 160 provided on the upper end of a vertical post 40 is moved rearward (i.e., toward the inside of the van), for example, the movable frame will tilt rearward. The lateral and inboard/outboard position of these parts is thereby adjusted.

Figure 14:
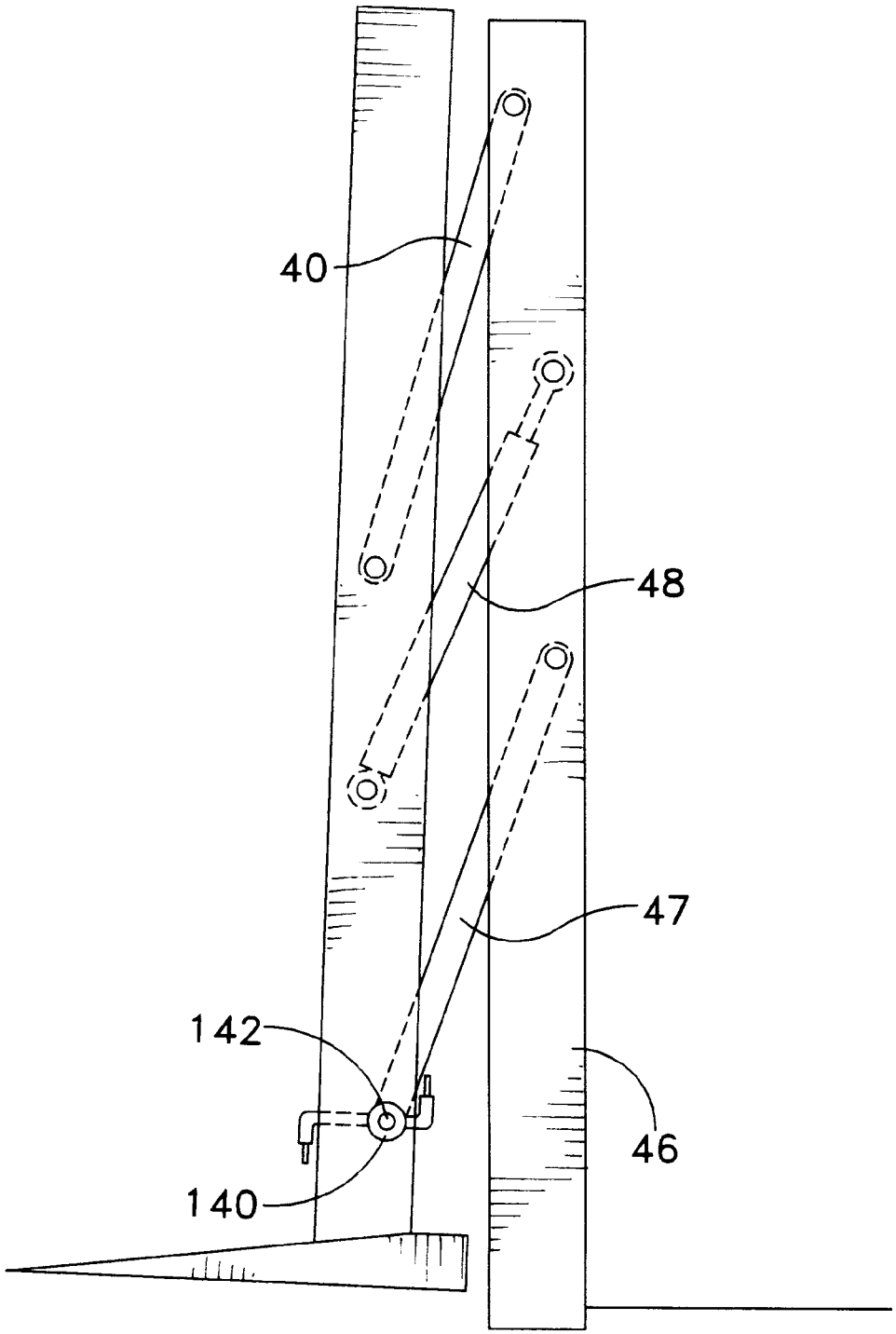
FIG. 14 is a side elevation, showing the combination of the hydraulic control valve, the hydraulic cylinder, the fixed post, vertically movable standard and parallelogram linkage.
Figure 15B:
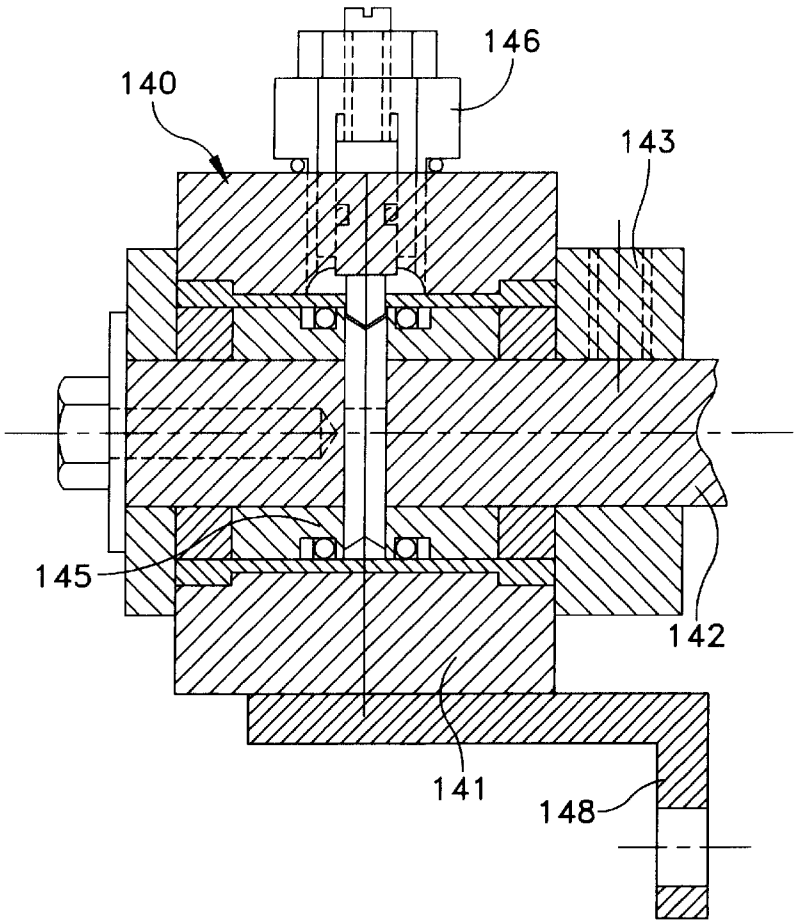
FIGS. 15A and 15B respectively are detailed lateral and longitudinal cut-away views of the hydraulic control valve of FIG. 14.
Figure 15A:
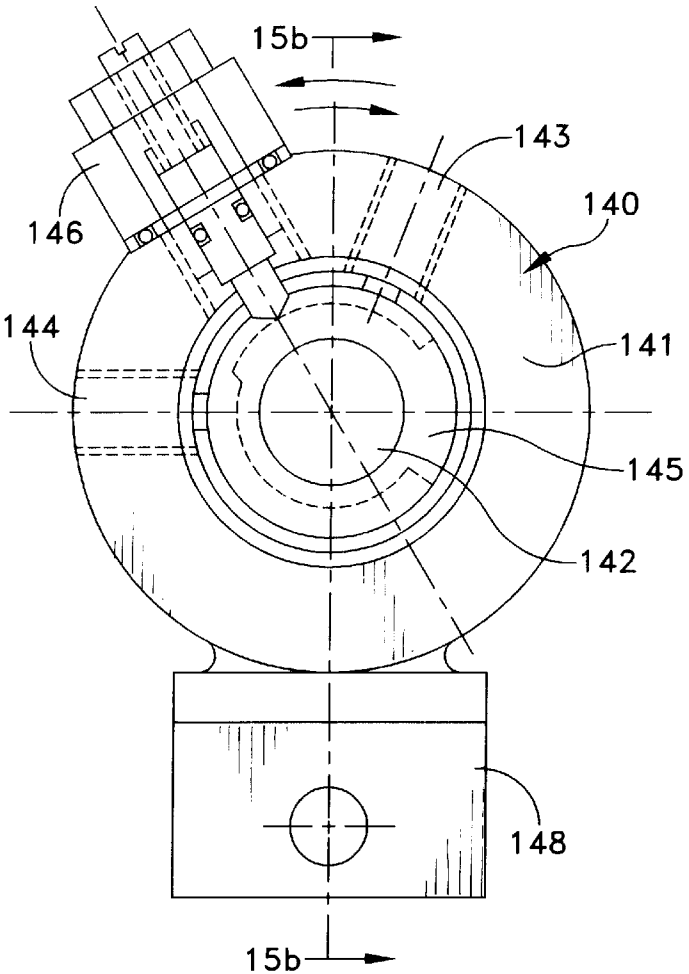

FIG. 14 shows the location of a variable hydraulic flow valve 140 which throttles the oil flow rate to the hydraulic cylinders 48 to limit the speed of platform 32 as it approaches the top and bottom of each lift cycle. FIGS. 15*a* and 15*b* show the structural particulars of the hydraulic flow valve 140. Valve 140 has a cylindrical housing 141, which has bores defining an inlet 143 and an outlet 144 and carries a rotatable cam 145 coupled to a shaft 142 of the parallelogram pivoting structure. Depending on the position of the parallelogram linkage, a follower 146 bearing against cam 145 extends more or less downwardly against the cam 145 and throttles the hydraulic flow accordingly. Preferably the cam 145 is shaped and positioned such that when the parallelogram linkage is retracted, for example by 80 to 90%, the flow is maintained at a reduced or throttled rate.

Housing 141 is fixed in position on vertical standard 40 by bracket 148. By relatively rotating cam 145 on shaft 142, it is possible to increase or decrease the portion of the span in which the flow is throttled. The position is set by a set screw 147 (FIG. 15B) threaded into cam 145 and against the shaft 142.

For the remainder or un-throttled portion of the displacement of the parallelogram linkage (i.e., as the platform approaches or moves away from the ground), a higher flow rate is permitted, allowing a faster motion. The platform thus is moved relatively more slowly over its span approaching or departing from the vehicle interior. The throttling of the flow can be, for example, 50% or more of the full flow rate.

The lift according to the invention can be varied in a number of ways. For example the lift can be mounted in a left or right doorway frame, to a rear door rather than a side door and behind swinging or sliding door panels. The foregoing discussion of preferred embodiments discloses a particular arrangement of linked movable elements and driving arrangements. However other specific couplings and drive arrangements will also achieve similar functional operation as described.

The invention having been disclosed in connection with the foregoing variations and examples, additional variations will now be apparent to persons skilled in the art. The invention is not intended to be limited to the variations specifically mentioned, and accordingly reference should be made to the appended claims rather than the foregoing discussion of preferred examples, to assess the scope of the invention in which exclusive rights are claimed.

What is claimed is:

1. A wheelchair lift for a doorway of a vehicle, comprising:

a platform for supporting a wheelchair;

at least two spaced fixed posts rigidly attachable to the vehicle at the doorway, defining at least a portion of a fixed structural frame;

at least two spaced movable vertical standards, attached to each of said fixed posts by at least two pivot arms coupled to spaced pivot points, such that each of said vertical standards and said one of the fixed posts form a parallelogram linkage with the pivot arms, the vertical standard being movable outwardly from a retracted position adjacent to said fixed post and downwardly while remaining vertical and parallel to the fixed posts;

wherein the platform is hinged on a horizontal axis relative to the two spaced movable vertical standards such that the platform can fold upward on the horizontal axis into a plane common with the vertical standards and adjacent to the fixed posts for compact stowing, and downward on the horizontal axis into a horizontal orientation for deployment for supporting the wheelchair;

wherein the horizontal axis of the platform is defined along a hinging base member that is furthermore attached to hinge on a vertical axis aligned along one of the movable vertical standards at a hinged end of the hinging base member, and the hinging base member is removably clamped to an other of the movable vertical standards at an opposite clamped end of the hinging base member; and, a powered actuator operable to extend and contract the parallelogram linkage and to raise and lower the platform relative to the doorway.

2. The wheelchair lift of claim 1, wherein the powered actuator is fixed on one end to one of the fixed posts and is fixed on an opposite end to one of the movable vertical standards.

3. The wheelchair lift according to claim 1, wherein the platform is hinged along a length of the hinging base member and the hinging base member has a protruding end opposite from an end at the vertical axis at one said movable vertical standard, which protruding end is rigidly attachable to the other movable vertical standard at the clamping end, via a manually operable clamping latch.

4. The wheelchair lift of claim 3, wherein the manually operable clamping latch engages a top and a side of the protruding end.

5. The wheelchair lift according to claim 1, wherein the actuator comprises at least one extendible hydraulic cylinder coupled to one of the fixed posts, and operable to expand or contract a parallelogram defined by said one of the fixed posts, one of the movable vertical standards, and the parallelogram linkages therebetween.

6. The wheelchair lift according to claim 5, comprising an additional actuator coupled to drive the platform in one or both directions for pivoting the platform about the horizontal hinge axis between a vertical stowed position and a horizontal deployed position.

7. The wheelchair lift according to claim 1, further comprising at least one roll-off gate forming a barrier movable into a blocking position for preventing rolling onto or off of the platform.

8. The wheelchair lift according to claim 7, further comprising a handrail member, and wherein at least one of the roll-off gate and the handrail is linked to at least one of said vertical standard and said fixed posts, for automatic deployment and retraction as a function of relative displacement of at least one of said vertical standards from said fixed posts and said platform from said vertical standards.

9. The wheelchair lift according to claim 1, further comprising a barrier mechanism comprising a barrier member which is linked by said barrier mechanism to deploy across an access path between the fixed posts, the barrier mechanism being coupled to deploy automatically and block the access path when the vertical standards are displaced from the fixed posts.

10. The wheelchair lift according to claim 9, wherein the barrier member is mechanically coupled to the barrier mechanism such that the barrier member is substantially deployed and retracted during over a portion of said relative displacement wherein the vertical standards and the fixed posts are at a minimum spacing.

11. The wheelchair lift according to claim 10, wherein the barrier member is mounted to the barrier mechanism via a spring biased lost motion assembly permitting displacement of the mechanism.

12. The wheelchair lift of claim 1, further comprising an outboard barrier movably raisable as a gate on an outboard side of the platform, wherein the outboard barrier has a latching dog that engages part of the outboard barrier for positively fixing the outboard barrier in a closed position, wherein contact between the lift and the ground moves a link bar in a direction toward opening the outboard barrier, and wherein the link bar has a span of lost motion in said direction toward opening the outboard barrier, in which span the link bar operates to disengage the latching dog.

13. The wheelchair lift of claim 1, further comprising complementary male and female structures mounted on the vertical standards and on the fixed posts, which are engaged upon retraction of the vertical standards against the fixed posts, whereby the vertical standards are fixed against lateral displacement and held at a fixed spacing relative to the fixed posts.

14. In combination, a vehicle having a doorway and a wheelchair lift, comprising:

a platform for supporting a wheelchair;

at least two spaced vertical posts rigidly fixed to the vehicle inside the doorway, and at least two horizontal beams extending between the vertical posts, wherein the posts and the beams form a structural frame in the doorway;

two spaced movable vertical standards, each of the standards being attached to one of the vertical posts by a parallelogram linkage comprising at least two pivot arms that hold the standards parallel to the posts, whereby the vertical standards remain vertical during movement of the parallelogram linkage;

wherein the platform is hingedly attached to one of the vertical standards so as to hinge on a vertical axis aligned along said one of the vertical standards, the platform being removably attached by a manually operable clamping mechanism to an opposite one of the standards; and, wherein the platform is also carried on a horizontal axis affixed to said one of the vertical standards such that the platform is hinged downward into a horizontal orientation for deployment and upward into a vertical orientation for stowing.

15. The combination of claim 14, further comprising means for raising and lowering the platform including at least one extendible hydraulic cylinder coupled relative to said posts, standards and pivot arms on at least one side of the doorway to expand or contract a parallelogram defined by the posts, the vertical standards, and the pivot arms, thereby guiding the vertical standards and the platform between the doorway and a ground surface adjacent to the vehicle.

16. The combination of claim 14, further comprising at least one roll-off gate and handrail member which are linked for automatic deployment and retraction together with the platform and the standards that carry the platform.

17. The combination of claim 14, further comprising a rear barrier which is linked for automatic deployment and retraction together with the platform and the standards that carry the platform.

18. A vehicle platform lift for a vehicle having a doorway on a passenger compartment, comprising:

two spaced vertical frame members fixed to the vehicle at opposite sides of the doorway;

two vertical standards coupled to the vertical frame members fixed to the vehicle, by parallelogram linkages having pivot arms pivotally attached at horizontal pivot axes to the frame members and to the vertical standards, whereby the vertical standards remain parallel to the vertical frame members fixed to the vehicle while the movable vertical standards are displaced vertically;

a platform coupled to the movable vertical standards, the platform being dimensioned to support a wheelchair over a path between the passenger compartment and a ground surface adjacent to the vehicle;

wherein in addition to said parallelogram linkages, the platform, the vertical standards and the vertical frame members fixed to the vehicle are respectively coupled together to form a first hinging axis oriented horizontally, whereby the platform can be pivoted on a horizontal axis that intersects and is perpendicular to one of the vertical standards, between a vertical stowed position and a horizontal deployed position, and a second hinge axis oriented vertically along said one of the vertical standards, whereby the platform when stowed upright is hingeable across or clear of the doorway.

* * * * *